US010975627B2

(12) United States Patent
Ling et al.

(10) Patent No.: US 10,975,627 B2
(45) Date of Patent: Apr. 13, 2021

(54) ROLLING ELEMENT ASSEMBLY WITH BEARINGS ELEMENTS

(71) Applicant: Halliburton Energy Services, Inc., Houston, TX (US)

(72) Inventors: Xianwu Ling, Conroe, TX (US); Gregory Christopher Grosz, Magnolia, TX (US); Brandon James Hinz, Conroe, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 94 days.

(21) Appl. No.: 16/311,126

(22) PCT Filed: Jul. 22, 2016

(86) PCT No.: PCT/US2016/043616
§ 371 (c)(1),
(2) Date: Dec. 18, 2018

(87) PCT Pub. No.: WO2018/017127
PCT Pub. Date: Jan. 25, 2018

(65) Prior Publication Data

US 2020/0003013 A1 Jan. 2, 2020

(51) Int. Cl.
*E21B 10/43* (2006.01)
*E21B 10/55* (2006.01)
(Continued)

(52) U.S. Cl.
CPC ..... *E21B 10/43* (2013.01); *E21B 10/55* (2013.01); *E21B 10/60* (2013.01); *E21B 10/633* (2013.01); *E21B 17/1057* (2013.01)

(58) Field of Classification Search
CPC ..... E21B 10/43; E21B 10/54; E21B 10/55; E21B 10/60; E21B 10/633; E21B 17/1057
See application file for complete search history.

(56) References Cited

U.S. PATENT DOCUMENTS 9,284,790 B2 3/2016 Shang et al.
2013/0015000 A1* 1/2013 Zhang ..... E21B 10/60 175/428

(Continued)

FOREIGN PATENT DOCUMENTS

CN 101765695 A 6/2010
WO 2016-057076 4/2016

OTHER PUBLICATIONS

Chinese Search Report for Application No. 2016800869635 dated Nov. 27, 2019.

(Continued)

*Primary Examiner* — Caroline N Butcher
(74) *Attorney, Agent, or Firm* — Thomas Rooney; C. Tumey Law Group PLLC

(57) ABSTRACT

A drill bit includes a bit body including one or more blades extending therefrom and a plurality of cutters secured to the one or more blades. A rolling element assembly is positioned within a cavity defined on the bit body and includes a housing, a rolling element rotatable within the housing about a rotational axis, and one or more bearing elements extendable into a corresponding one or more arcuate grooves defined in the cavity to secure the housing within the cavity. The housing encircles more than 180° but less than 360° of a circumference of the rolling element while leaving a full axial width of the rolling element exposed.

20 Claims, 9 Drawing Sheets

(51) Int. Cl.

| | |
|---|---|
| ***E21B 10/633*** | (2006.01) |
| *E21B 10/60* | (2006.01) |
| *E21B 17/10* | (2006.01) |

(56) References Cited

U.S. PATENT DOCUMENTS

| | | | | |
|---|---|---|---|---|
| 2013/0146367 | A1* | 6/2013 | Zhang | E21B 10/633 175/374 |
| 2014/0326515 | A1 | 11/2014 | Shi et al. | |
| 2014/0360792 | A1* | 12/2014 | Azar | E21B 10/5735 175/432 |
| 2016/0153243 | A1* | 6/2016 | Hinz | E21B 10/633 175/57 |

OTHER PUBLICATIONS

International Search Report and Written Opinion for PCT/US2016/043616 dated Apr. 21, 2017.

* cited by examiner

ROLLING ELEMENT ASSEMBLY WITH BEARINGS ELEMENTS

BACKGROUND

In conventional wellbore drilling in the oil and gas industry, a drill bit is mounted on the end of a drill string, which may be extended by adding segments of drill pipe as the well is progressively drilled to the desired depth. At the surface of the well site, a rotary drive (referred to as a "top drive") may be provided to rotate the entire drill string, including the drill bit at the end, to drill through the subterranean formation. Alternatively, the drill bit may be rotated using a downhole mud motor without having to rotate the drill string. When drilling, drilling fluid is pumped through the drill string and discharged from the drill bit to remove cuttings and debris. The mud motor, if present in the drill string, may be selectively powered using the circulating drilling fluid.

One common type of drill bit used to drill wellbores is a "fixed cutter" bit, wherein the cutters are secured to the bit body at fixed positions. This type of bit is sometimes referred to as a "drag bit" since the cutters in one respect drag rather than roll in contact with the formation during drilling. The bit body may be formed from a high strength material, such as tungsten carbide, steel, or a composite/matrix material. A plurality of cutters (also referred to as cutter elements, cutting elements, or inserts) are attached at selected locations about the bit body. The cutters may include a substrate or support stud made of a carbide (e.g., tungsten carbide), and an ultra-hard cutting surface layer or "table" made of a polycrystalline diamond material or a polycrystalline boron nitride material deposited onto or otherwise bonded to the substrate. Such cutters are commonly referred to as polycrystalline diamond compact ("PDC") cutters.

In fixed cutter drill bits, PDC cutters are rigidly secured to the bit body, such as by being brazed within corresponding cutter pockets defined on blades that extend from the bit body. Some of the PDC cutters are strategically positioned along the leading edges of the blades to engage the formation during drilling. In use, high forces are exerted on the PDC cutters, particularly in the forward-to-rear direction. Over time, the working surface or cutting edge of each cutter that continuously contacts the formation eventually wears down and/or fails.

BRIEF DESCRIPTION OF THE DRAWINGS

The following figures are included to illustrate certain aspects of the present disclosure, and should not be viewed as exclusive embodiments. The subject matter disclosed is capable of considerable modifications, alterations, combinations, and equivalents in form and function, without departing from the scope of this disclosure.

DETAILED DESCRIPTION

Figure 1A:
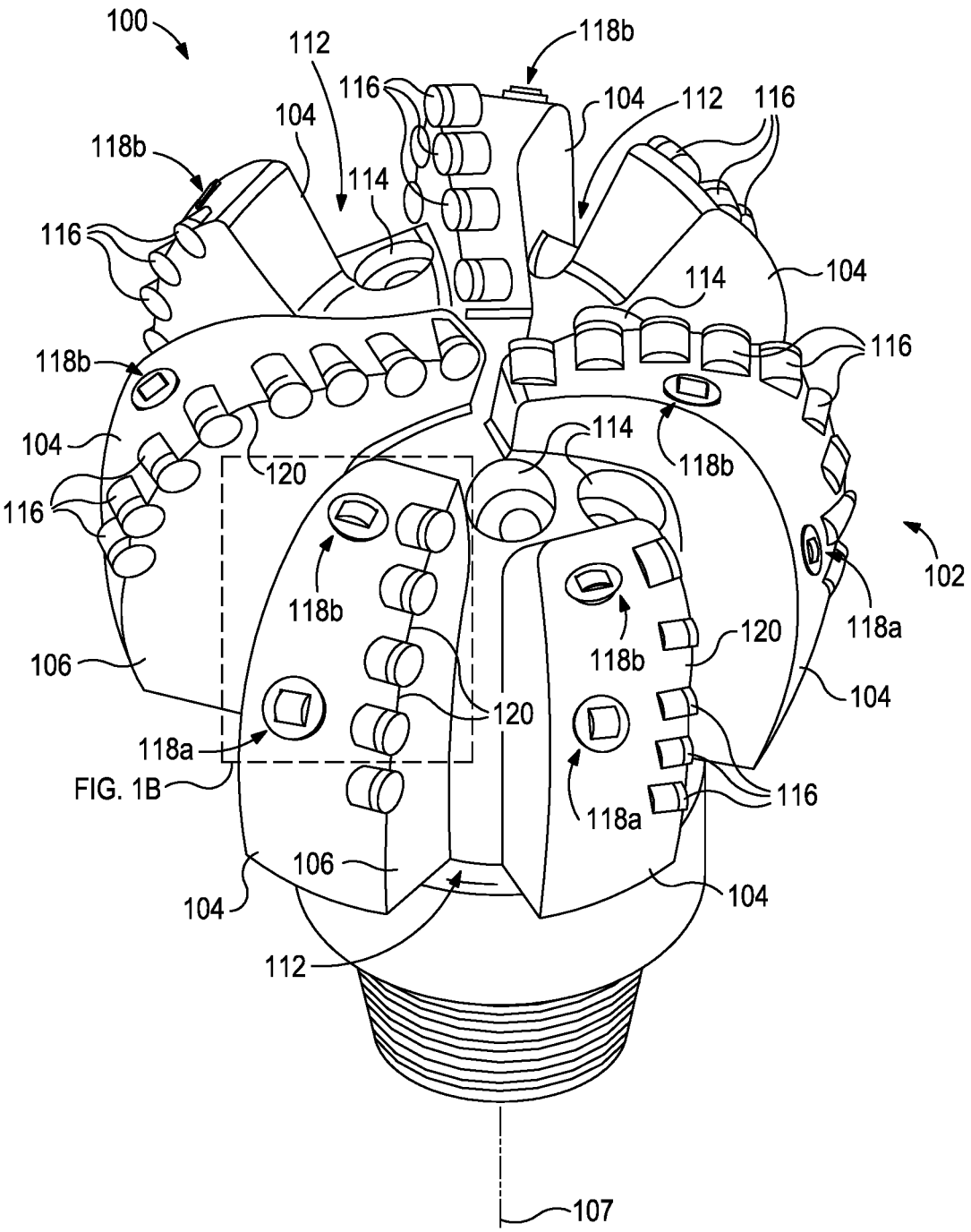
FIG. 1A illustrates an isometric view of a rotary drill bit that may employ the principles of the present disclosure.

The present disclosure relates to earth-penetrating drill bits and, more particularly, to rolling type depth of cut control elements that can be used in drill bits.

The present disclosure includes rolling element assemblies that can be secured within corresponding cavities provided on a drill bit. Each rolling element assembly may include a cylindrical rolling element strategically positioned and secured to the drill bit so that the rolling element is able to engage the formation during drilling. In response to drill bit rotation, and depending on the selected positioning (orientation) of the rolling element with respect to the body of the drill bit, the rolling element may roll against the underlying formation, cut against the formation, or may both roll against and cut the formation. The rolling elements of the presently disclosed rolling element assemblies are retained within corresponding cavities on the bit body using an arcuate retainer received within a retainer cavity defined in the cavity.

The orientation of each rolling element with respect to the bit body is selected to produce a variety of different functions and/or effects. The selected orientation includes, for example, a selected side rake and/or a selected back rake. In some cases while drilling, the rolling element may be configured as a rolling cutting element that both rolls along the formation (e.g., by virtue of a selected range of side rake) and cuts the formation (e.g., by virtue of the selected back rake and/or side rake). More particularly, the rolling cutting element may be positioned to cut, dig, scrape, or otherwise remove material from the formation using a portion of the rolling element (e.g., a polycrystalline diamond table) that is positioned to engage the formation.

In some example embodiments, the rolling element assemblies described herein can be configured as rolling cutting elements. The rolling cutting elements may be configured to rotate freely about a rotational axis and, as a result, the entire outer edge of the rolling cutting element may be used as a cutting edge. Consequently, rather than only a limited portion of the cutting edge being exposed to the formation during drilling, as in the case of conventional fixed cutters, the entire outer edge of the rolling cutting element will be successively exposed to the formation as it rotates about its rotational axis during drilling. This results in a more uniform cutting edge wear, which may prolong the operational lifespan of the rolling cutting element as compared to conventional cutters.

In other example embodiments, the rolling element assemblies described herein can be configured as rolling depth of cut control (DOCC) elements that roll along the formation as the drill bit rotates. In a rolling DOCC element configuration, the orientation of the rolling element may be selected so that a full axial span of the rolling element bears against the formation. As with rolling cutting elements, rolling DOCC elements may exhibit enhanced wear resilience and allow for additional weight-on-bit without negatively affecting torque-on-bit. This may allow a well operator to minimize damage to the drill bit, thereby reducing trips and non-productive time, and decreasing the aggressiveness of the drill bit without sacrificing its efficiency. The rolling DOCC elements described herein may also reduce friction at the interface between the drill bit and the formation, and thereby allow for a steady depth of cut, which results in better tool face control.

In yet other example embodiments, the rolling element assemblies described herein may operate as a hybrid between a rolling cutting element and a rolling DOCC element. This may be accomplished by orienting the rotational axis of the rolling element on a plane that does not pass through the longitudinal axis of the drill bit nor is the plane oriented perpendicular to a plane that does pass through the longitudinal axis of the drill bit. Those skilled in the art will readily appreciate that the presently disclosed embodiments may improve upon hybrid rock bits, which use a large roller cone element as a depth of cut limiter by sacrificing diamond volume. In contrast, the presently disclosed rolling element assemblies are small in comparison and its enablement will not result in a significant loss of diamond volume on a fixed cutter drag bit.

FIG. 1A is an isometric view of an exemplary drill bit 100 that may employ the principles of the present disclosure. The drill bit 100 is depicted as a fixed cutter drill bit, and the present teachings may be applied to any fixed cutter drill bit category, including polycrystalline diamond compact (PDC) drill bits, drag bits, matrix drill bits, and/or steel body drill bits. While the drill bit 100 is depicted in FIG. 1A as a fixed cutter drill bit, however, the principles of the present disclosure are equally applicable to other types of drill bits operable to form a wellbore including, but not limited to, roller cone drill bits.

The drill bit 100 has a bit body 102 that includes radially and longitudinally extending blades 104 having leading faces 106. The bit body 102 may be made of steel or a matrix of a harder material, such as tungsten carbide. The bit body 102 rotates about a longitudinal drill bit axis 107 to drill into underlying subterranean formation under an applied weight-on-bit. Corresponding junk slots 112 are defined between circumferentially adjacent blades 104, and a plurality of nozzles or ports 114 can be arranged within the junk slots 112 for ejecting drilling fluid that cools the drill bit 100 and otherwise flushes away cuttings and debris generated while drilling.

The bit body 102 further includes a plurality of cutters 116 secured within a corresponding plurality of cutter pockets sized and shaped to receive the cutters 116. Each cutter 116 in this example comprises a fixed cutter secured within its corresponding cutter pocket via brazing, threading, shrink-fitting, press-fitting, snap rings, or any combination thereof. The fixed cutters 116 are held in the blades 104 and respective cutter pockets at predetermined angular orientations and radial locations to present the fixed cutters 116 with a desired back rake angle against the formation being penetrated. As the drill string is rotated, the fixed cutters 116 are driven through the rock by the combined forces of the weight-on-bit and the torque experienced at the drill bit 100. During drilling, the fixed cutters 116 may experience a variety of forces, such as drag forces, axial forces, reactive moment forces, or the like, due to the interaction with the underlying formation being drilled as the drill bit 100 rotates.

Each fixed cutter 116 may include a generally cylindrical substrate made of an extremely hard material, such as tungsten carbide, and a cutting face secured to the substrate. The cutting face may include one or more layers of an ultra-hard material, such as polycrystalline diamond, polycrystalline cubic boron nitride, impregnated diamond, etc., which generally forms a cutting edge and the working surface for each fixed cutter 116. The working surface is typically flat or planar, but may also exhibit a curved exposed surface that meets the side surface at a cutting edge.

Generally, each fixed cutter 116 may be manufactured using tungsten carbide as the substrate. While a cylindrical tungsten carbide "blank" can be used as the substrate, which is sufficiently long to act as a mounting stud for the cutting face, the substrate may equally comprise an intermediate layer bonded at another interface to another metallic mounting stud. To form the cutting face, the substrate may be placed adjacent a layer of ultra-hard material particles, such as diamond or cubic boron nitride particles, and the combination is subjected to high temperature at a pressure where the ultra-hard material particles are thermodynamically stable. This results in recrystallization and formation of a polycrystalline ultra-hard material layer, such as a polycrystalline diamond or polycrystalline cubic boron nitride layer, directly onto the upper surface of the substrate. When using polycrystalline diamond as the ultra-hard material, the fixed cutter 116 may be referred to as a polycrystalline diamond compact cutter or a "PDC cutter," and drill bits made using such PDC fixed cutters 116 are generally known as PDC bits.

As illustrated, the drill bit 100 may further include a plurality of rolling element assemblies 118, shown as rolling element assemblies 118*a* and 118*b*. The orientation of a rotational axis of each rolling element assembly 118*a,b* with respect to a tangent to an outer surface of the blade 104 may dictate whether the particular rolling element assembly 118*a,b* operates as a rolling DOCC element, a rolling cutting element, or a hybrid of both. As mentioned above, rolling DOCC elements may prove advantageous in allowing for additional weight-on-bit (WOB) to enhance directional drilling applications without over engagement of the fixed cutters 116. Effective DOCC also limits fluctuations in torque and minimizes stick-slip, which can cause damage to the fixed cutters 116.

Figure 1B:
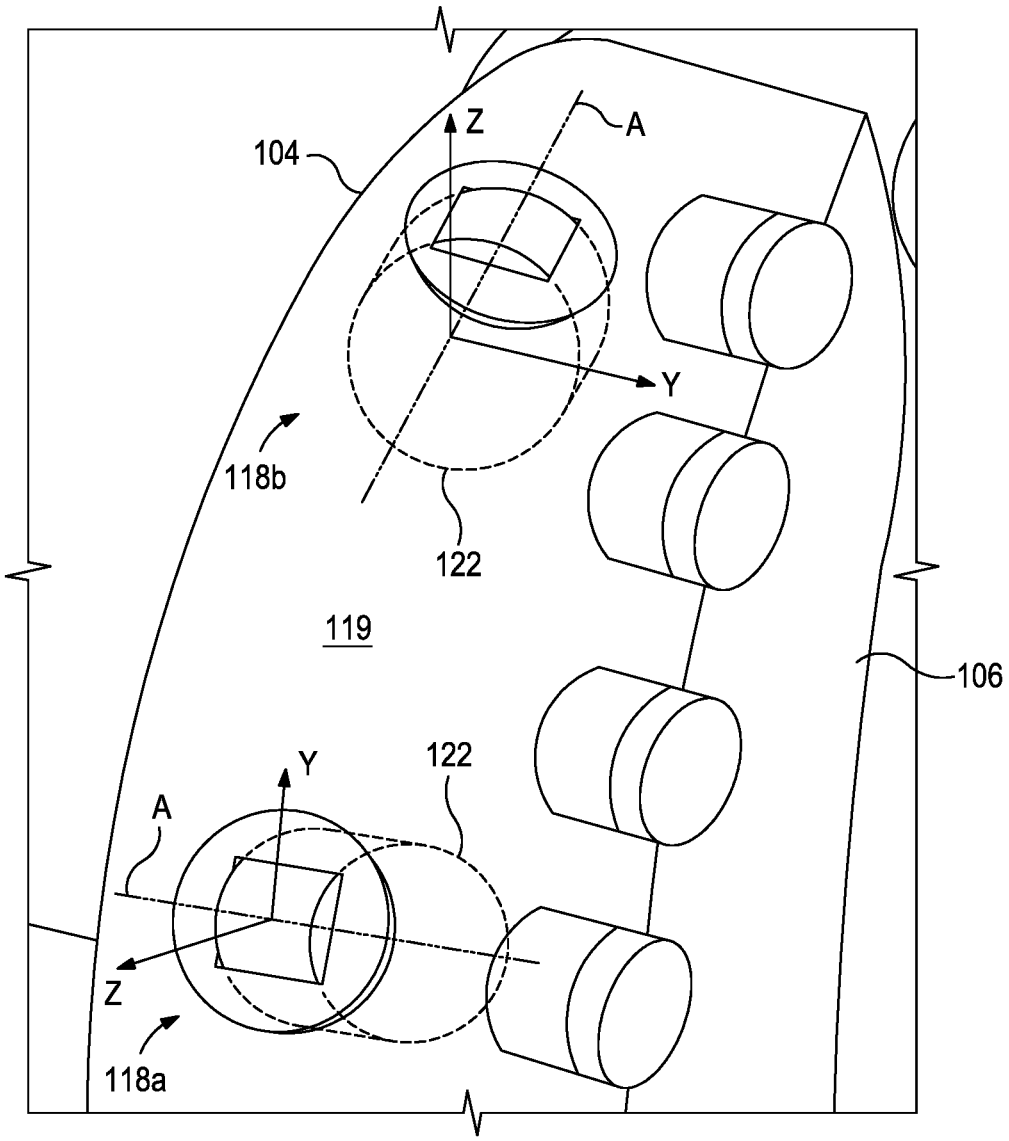
FIG. 1B illustrates an isometric view of a portion of the rotary drill bit enclosed in the indicated box of FIG. 1A.

FIG. 1B is an enlarged portion of the drill bit 100 indicated by the dashed box shown in FIG. 1A. As shown in FIG. 1B, each rolling element assembly 118*a,b* is located in the blade 104 and includes a rolling element 122. Exposed portions of the rolling elements 122 are illustrated in solid linetype, while portions of the rolling elements 122 that are seated within corresponding housings of the rolling element assemblies 118*a,b* are illustrated in dashed linetype. Each rolling element 122 has a rotational axis A, a Z-axis that is perpendicular to the blade profile 138 (FIG. 1D), and a Y-axis that is orthogonal to both the rotational and Z axes.

If, for example, the rotational axis A of the rolling element 122 is substantially parallel to a tangent to the outer surface 119 of the blade profile, the rolling element assembly 118*a,b* may generally operate as a rolling DOCC element. Said differently, if the rotational axis A of the rolling element 122 passes through or lies on a plane that passes through the longitudinal axis 107 (FIG. 1A) of the drill bit 100 (FIG. 1A), then the rolling element assembly 118*a,b* may substantially operate as a rolling DOCC element. If, however, the rotational axis A of the rolling element 122 is substantially perpendicular to the leading face 106 of the blade 104, then the rolling element assembly 118*a,b* may substantially operate as a rolling cutting element. Thus, if the rotational axis A of the rolling element 122 is perpendicular to or lies on a plane that is perpendicular to a plane passing through the longitudinal axis 107 (FIG. 1A) of the drill bit 100 (FIG. 1A), then the rolling element assembly 118*a,b* may substantially operate as a rolling cutting element.

Accordingly, as depicted in FIG. 1B, the first rolling element assembly 118*a* may be positioned to operate as a rolling cutting element and the second rolling element assembly 118*b* may be positioned to operate as a rolling DOCC element. In embodiments where the rotational axis A of the rolling element 122 lies on a plane that does not pass through the longitudinal axis 107 (FIG. 1A) of the drill bit 100 (FIG. 1A) nor is the plane perpendicular to the longitudinal axis 107, the rolling element assembly 118*a,b* may then operate as a hybrid rolling DOCC and cutting element.

Traditional load-bearing type cutting elements for DOCC unfavorably affect torque-on-bit (TOB) by simply dragging, sliding, etc. along the formation, whereas a rolling DOCC element, such as the presently described rolling element assemblies 118*b*, may reduce the amount of torque needed to drill a formation because it rolls to reduce friction losses typical with load bearing DOCC elements. A rolling DOCC element will also have reduced wear as compared to a traditional bearing element. As will be appreciated, however, one or more of the rolling element assemblies 118*b* can also be used as rolling cutting elements, which may increase cutter effectiveness since it will distribute heat more evenly over the entire cutting edge and minimize the formation of localized wear flats on the rolling cutting element.

Figure 1C:
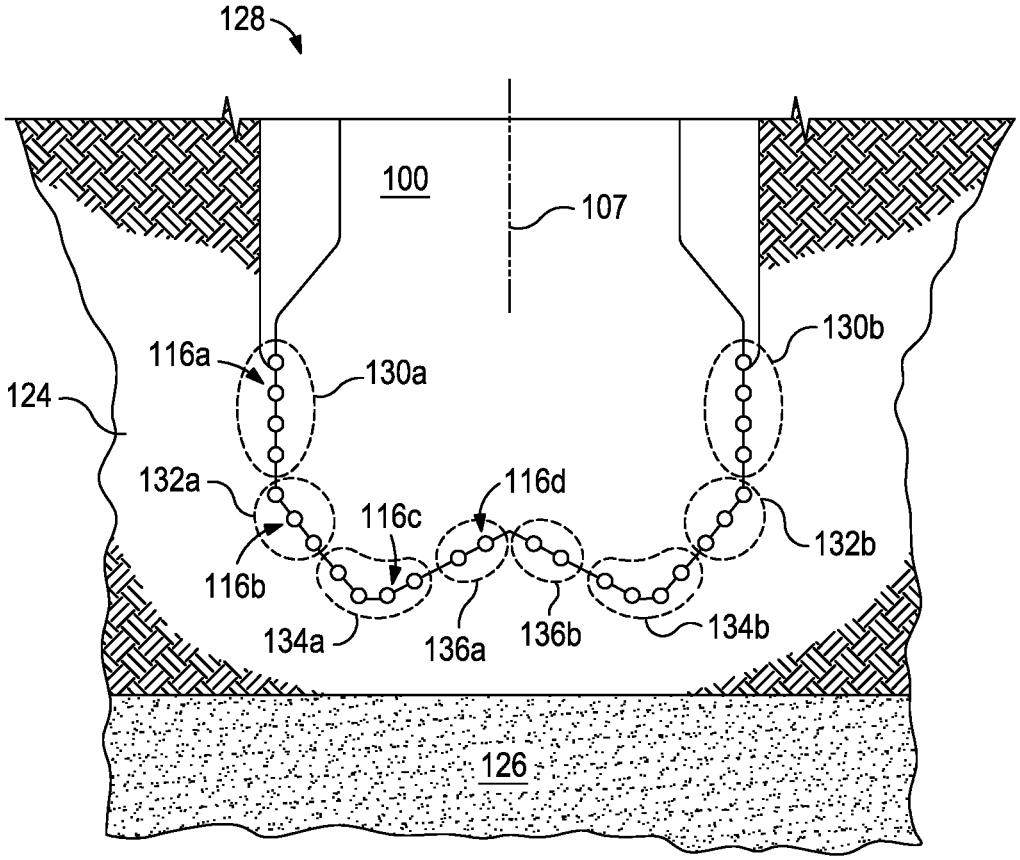
FIG. 1C illustrates a drawing in section and in elevation with portions broken away showing the drill bit of FIG. 1.

FIG. 1C is a drawing in section and in elevation with portions broken away showing the drill bit 100 drilling a wellbore through a first downhole formation 124 and into an underlying second downhole formation 126. The first downhole formation 124 may be described as softer or less hard when compared to the second downhole formation 126. Exterior portions of the drill bit 100 that contact adjacent portions of the first and/or second downhole formations 124, 126 may be described as a bit face, and are projected rotationally onto a radial plane to provide a bit face profile 128. The bit face profile 128 of the drill bit 100 may include various zones or segments and may be substantially symmetric about the longitudinal axis 107 of the drill bit 100 due to the rotational projection of the bit face profile 128, such that the zones or segments on one side of the longitudinal axis 107 may be substantially similar to the zones or segments on the opposite side of the longitudinal axis 107.

For example, the bit face profile 128 may include a first gage zone 130*a* located opposite a second gage zone 130*b*, a first shoulder zone 132*a* located opposite a second shoulder zone 132*b*, a first nose zone 134*a* located opposite a second nose zone 134*b*, and a first cone zone 136*a* located opposite a second cone zone 136*b*. The fixed cutters 116 included in each zone may be referred to as cutting elements of that zone. For example, the fixed cutters 116*a* included in gage zones 130*a,b* may be referred to as gage cutting elements, the fixed cutters 116*b* included in shoulder zones 132*a,b* may be referred to as shoulder cutting elements, the fixed cutters 116*c* included in nose zones 134*a,b* may be referred to as nose cutting elements, and the fixed cutters 116*d* included in cone zones 136*a,b* may be referred to as cone cutting elements.

Cone zones 136*a,b* may be generally concave and may be formed on exterior portions of each blade 104 (FIG. 1A) of the drill bit 100, adjacent to and extending out from the longitudinal axis 107. The nose zones 134*a,b* may be generally convex and may be formed on exterior portions of each blade 104, adjacent to and extending from each cone zone 136. Shoulder zones 132*a,b* may be formed on exterior portions of each blade 104 extending from respective nose zones 134*a,b* and may terminate proximate to a respective gage zone 130*a,b*. The area of the bit face profile 128 may depend on cross-sectional areas associated with zones or segments of the bit face profile 128 rather than on a total number of fixed cutters 116, a total number of blades 104, or cutting areas per fixed cutter 116.

Figure 1D:
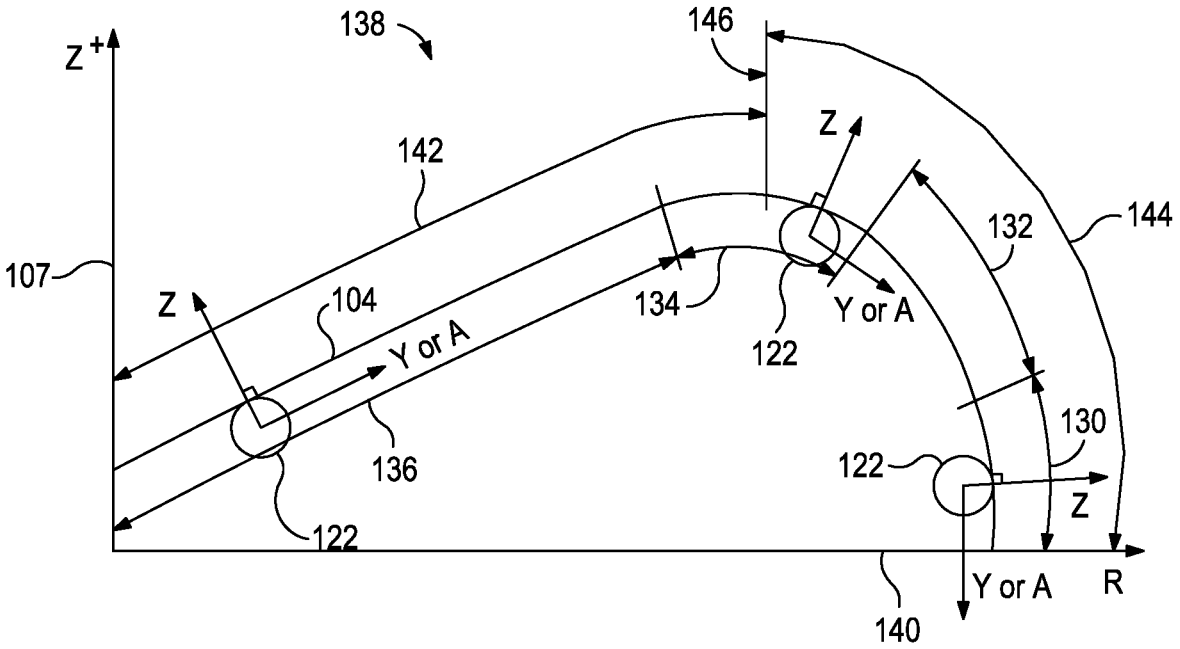
FIG. 1D illustrates a blade profile that represents a cross-sectional view of a blade of the drill bit of FIG. 1.

FIG. 1D illustrates a blade profile 138 that represents a cross-sectional view of one of the blades 104 of the drill bit 100 (FIG. 1A). The blade profile 138 includes the cone zone 136, the nose zone 134, the shoulder zone 132 and the gage zone 130, as described above with respect to FIG. 1C. Each zone 130, 132, 134, 135 may be based on its respective location along the blade 104 with respect to the longitudinal axis 107 and a horizontal reference line 140 that indicates a distance from the longitudinal axis 107 in a plane perpendicular to the longitudinal axis 107. A comparison of FIGS. 1C and 1D shows that the blade profile 138 of FIG. 1D is upside down with respect to the bit face profile 128 of FIG. 1C.

The blade profile 138 includes an inner zone 142 and an outer zone 144. The inner zone 142 extends outward from the longitudinal axis 107 to a nose point 146, and the outer zone 144 extends from the nose point 146 to the end of the blade 104. The nose point 146 may be a location on the blade profile 138 within the nose zone 134 that has maximum elevation as measured by the bit longitudinal axis 107 (vertical axis) from reference line 140 (horizontal axis). A coordinate on the graph in FIG. 1D corresponding to the longitudinal axis 107 may be referred to as an axial coordinate or position. A coordinate corresponding to reference line 140 may be referred to as a radial coordinate or radial position that indicates a distance extending orthogonally from the longitudinal axis 107 in a radial plane passing through longitudinal axis 107. For example, in FIG. 1D, the longitudinal axis 107 may be placed along a Z-axis and the reference line 140 may indicate the distance (R) extending orthogonally from the longitudinal axis 107 to a point on a radial plane that may be defined as the Z-R plane.

Depending on how the rotational axis A (FIG. 1B) of each rolling element assembly 118*a,b* (FIG. 1B) is oriented with respect to the longitudinal axis 107, and, more particularly with respect to the Z-R plane that passes through the longitudinal axis 107, the rolling assemblies 118*a,b* may operate as a rolling DOCC element, a rolling cutting element, or a hybrid thereof. The rolling element assembly 118*a,b* will generally operate as a rolling DOCC element if the rotational axis A of the rolling element 122 lies on the Z-R plane, but will generally operate as a rolling cutting element if the rotational axis A of the rolling element 122 lies on a plane perpendicular to the Z-R plane. The rolling element assembly 118*a,b* may operate as a hybrid rolling DOCC element and a rolling cutting element in embodiments where the rotational axis A of the rolling element 122 lies on a plane offset from the Z-R plane, but not perpendicular thereto.

Depending on how they are oriented with respect to the longitudinal axis 107, each rolling element assembly 118*a,b* (FIG. 1B) may exhibit side rake or back rake during operation. Side rake can be defined as the angle between the rotational axis A (FIG. 1B) of the rolling element 122 and the Z-R plane that extends through the longitudinal axis 107. When the rotational axis A is parallel to the Z-R plane, the side rake is substantially 0°, such as in the case of the second rolling element assembly 118*b* of FIG. 1B. When the rotational axis A is perpendicular to the Z-R plane, however, the side rake is substantially 90°, such as in the case of the first rolling element assembly 118*a* of FIG. 1B. When viewed along the Z-axis from the positive Z-direction (viewing toward the negative Z-direction), a negative side rake results from counterclockwise rotation of the rolling element 122, and a positive side rake results from clockwise rotation of the rolling element 122. Said differently, when viewing from the top of the blade profile 128, a negative side rake results from counterclockwise rotation of the rolling element 122, and a positive side rake results from clockwise rotation of the rolling element 122 about the Z-axis.

Back rake can be defined as the angle subtended between the Z-axis of a given rolling element 122 and the Z-R plane. More particularly, as the Z-axis of a given rolling element 122 rotates offset backward or forward from the Z-R plane, the amount of offset rotation is equivalent to the measured back rake. If, however, the Z-axis of a given rolling element 122 lies on the Z-R plane, the back rake for that rolling element 122 will be 0°.

In some embodiments, one or more of the rolling element assemblies 118*a,b* may exhibit a side rake that ranges between 0° and 45° (or 0° and −45°, or alternatively a side rake that ranges between 45° and 90° (or −45° and −90°. In other embodiments, one or more of the rolling element assemblies 118*a,b* may exhibit a back rake that ranges between 0° and 45° (or 0° and −45°. The selected side rake will affect the amount of rolling versus the amount of sliding that a rolling element 122 included with the rolling element assembly 118*a,b* will undergo, whereas the selected back rake will affect how a cutting edge of the rolling element 122 engages the formation (e.g., the first and second formations 124, 126 of FIG. 1C) to cut, scrape, gouge, or otherwise remove material.

Referring again to FIG. 1A, the second rolling element assemblies 118*b* may be placed in the cone region of the drill bit 100 and otherwise positioned so that rolling element assemblies 118*b* track in the path of the adjacent fixed cutters 116; e.g., they are placed in a secondary row behind the primary row of fixed cutters 116 on the blade 104. However, since the second rolling element assemblies 118*b* are able to roll, they can be placed in positions other than the cone without affecting TOB.

Strategic placement of the first and second rolling element assemblies 118*a,b* may further allow them to be used as either primary and/or secondary rolling cutting elements as well as rolling DOCC elements, without departing from the scope of the disclosure. For instance, in some embodiments, one or more of the rolling element assemblies 118*a,b* may be located in a kerf forming region 120 located between adjacent fixed cutters 116. During operation, the kerf forming region 120 results in the formation of kerfs on the underlying formation being drilled. One or more of the rolling element assemblies 118*a,b* may be located on the bit body 102 such that they will engage and otherwise extend across one or multiple formed kerfs during drilling operations. In such an embodiment, the rolling element assemblies 118*a,b* may also function as prefracture elements that roll on top of or otherwise crush the kerf(s) formed on the underlying formation between adjacent fixed cutters 116. In other cases, one or more of the rolling element assemblies 118*a,b* may be positioned on the bit body 102 such that they will proceed between adjacent formed kerfs during drilling operations. In yet other embodiments, one or more of the rolling element assemblies 118*a,b* may be located at or adjacent the apex of the drill bit 100 (i.e., at or near the longitudinal axis 107). In such embodiments, the drill bit 100 may fracture the underlying formation more efficiently.

In some embodiments, as illustrated, the rolling element assemblies 118*a,b* may each be positioned on a respective blade 104 such that the rolling element assemblies 118*a,b* extend orthogonally from the outer surface 119 (FIG. 1B) of the respective blade 104. In other embodiments, however, one or more of the rolling element assemblies 118*a,b* may be positioned at a predetermined angular orientation (three degrees of freedom) offset from normal to the profile of the outer surface 119 of the respective blade 104. As a result, the rolling element assemblies 118*a,b* may exhibit an altered or desired back rake angle, side rake angle, or a combination of both. As will be appreciated, the desired back rake and side rake angles may be adjusted and otherwise optimized with respect to the primary fixed cutters 116 and/or the surface 119 (FIG. 1B) of the blade 104 on which the rolling element assemblies 118*a,b* are disposed.

Figure 2:
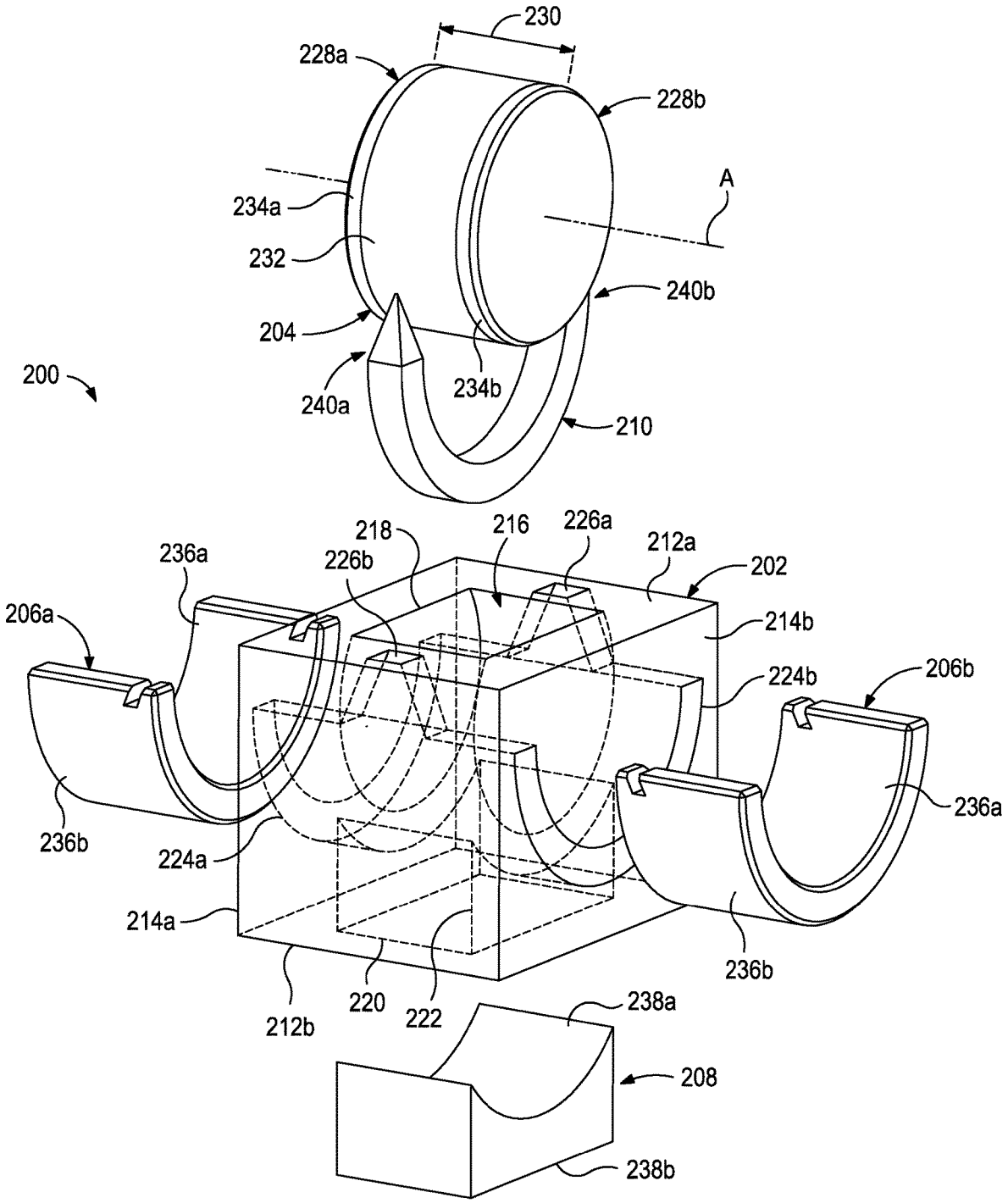
FIG. 2 is an exploded isometric view of an example rolling element assembly.

FIG. 2 is an exploded isometric view of one example of a rolling element assembly 200, according to one or more embodiments. The rolling element assembly 200 may be used, for example, with the drill bit 100 of FIGS. 1A-1B, in which case the rolling element assembly 200 may be a substitution for either of the rolling element assemblies 118*a,b* or a specific example embodiment of the rolling element assemblies 118*a,b*. As illustrated, the rolling element assembly 200 may include a housing 202, a rolling element 204, a pair of arcuate bearing elements 206*a* and 206*b*, a support base 208, and a locking element 210. As discussed below, the rolling element assembly 200 may be assembled and secured within one of the blades 104 (FIGS. 1A-1B) of the drill bit 100 and operate as one of a rolling cutting element, a rolling DOCC element, or a hybrid between a rolling cutting element and a rolling DOCC element.

The housing 202 is depicted in FIG. 2 in phantom (i.e., dashed linetype) to be able to view its internal features that allow the rolling element assembly 200 to be fully assembled. The housing 202 may be configured and otherwise designed to receive each of the rolling element 204, the bearing elements 206*a,b*, the support base 208, and the locking element 210 when the rolling element assembly 200 is fully assembled. The housing 202 may be made of tungsten carbide, steel, an engineering metal, a coated material (i.e., using processes such as chemical vapor deposition, plasma vapor deposition, etc.), or other hard or suitable abrasion resistant materials. In some embodiments, the housing 202 may be made of steel and the internal features of the housing 202 may be machined to desired dimensions. In other embodiments, the housing 202 and its internal features may be molded or cast into their desired shapes and subsequently machined to tolerances.

The housing 202 comprises a generally cube-shaped body (i.e., square, rectangular, etc.) that provides a top surface 212*a*, a bottom surface 212*b* opposite the top surface 212*a*, a first lateral side 214*a*, and a second lateral side 214*b* opposite the first lateral side 214*b*. While the housing 202 is shown and described herein as being cube-shaped, it will be appreciated that the housing 202 may alternatively be formed in other shapes. For instance, the housing 202 may alternatively exhibit curved or rounded outer features, without departing from the scope of the disclosure.

The housing 202 provides and otherwise defines an inner chamber 216 sized to receive the rolling element 204 and allow the rolling element 204 to rotate about a rotational axis A during operation. An opening 218 defined in the top surface 212*a* allows an arcuate portion of the rolling element

204 to extend out of the inner chamber 216 when the rolling element 204 is installed within the housing 202. The opening 218, however, is sized such that the housing 202 encircles (encloses) more than 180° degrees of the rolling element 204, but less than 360°, which secures the rolling element 204 in the housing 202 during operation. As a result, as the rolling element 204 rotates about the rotational axis A, the arcuate portion extending through the opening 218 is able to engage (i.e., cut, roll against, or both) an underlying formation.

The bottom surface 212*b* defines a support opening 220 and a support cavity 222 extends from the support opening 220 within the housing 202 and transitions into the inner chamber 216. The support opening 220 is sized and otherwise configured to receive the rolling element 204 and the support base 208. Accordingly, the rolling element 204 may be installed in the housing 202 via the support opening 220 and advanced into the interior of the housing 202 until received in the inner chamber 216. The support cavity 222 is sized to receive and seat the support base 208 and, as described below, the support base 208 may be installed in the housing 202 following installation of the rolling element 204 and the bearing elements 206*a,b* to help support the rolling element 204 during operation.

The housing 202 further provides a first arcuate slot 224*a* defined on the first lateral side 214*a* and a second arcuate slot 224*b* defined on the second lateral side 214*b*. The first and second arcuate slots 224*a,b* extend laterally into the housing 202 to communicate with the inner chamber 216 and are sized and otherwise configured to receive the first and second arcuate bearing elements 206*a,b*, respectively, during assembly of the rolling element assembly 200. In some contexts, the first and second arcuate slots 224*a,b* may be characterized as a continuous arcuate slot that extends continuously between the first and second lateral sides 214*a,b*.

The housing 202 may further provide one or more lock apertures 226 defined in the top surface 212*a* and each extending into the housing 202 to communicate with the inner chamber 216. The lock apertures are shown as a first lock aperture 226*a* and a second lock aperture 226*b* and are each sized to receive the locking element 210, which, as described herein, helps secure the rolling element assembly 200 to a drill bit (e.g., the drill bit 100 of FIG. 1A).

The rolling element 204 comprises a generally cylindrical or disk-shaped body having a first axial end 228*a* and a second axial end 228*b* opposite the first axial end 228*a* along the rotational axis A. The distance between the first and second axial ends 228*a,b* is referred to herein as the axial width 230 of the rolling element 204.

In some embodiments, the rolling element 204 includes a substrate 232 and opposing diamond tables 234*a* and 234*b* are arranged at the first and second axial ends 228*a,b*, respectively, and otherwise coupled to opposing axial ends of the substrate 232. The substrate 232 may be formed of a variety of hard or ultra-hard materials including, but not limited to, steel, steel alloys, tungsten carbide, cemented carbide, any derivatives thereof, and any combinations thereof. Suitable cemented carbides may contain varying proportions of titanium carbide (TiC), tantalum carbide (TaC), and niobium carbide (NbC). Additionally, various binding metals may be included in the substrate 232, such as cobalt, nickel, iron, metal alloys, or mixtures thereof. In the substrate 232, the metal carbide grains are supported within a metallic binder, such as cobalt. In other cases, the substrate 232 may be formed of a sintered tungsten carbide composite structure or a diamond ultra-hard material, such as polycrystalline diamond (PCD) or thermally stable polycrystalline diamond (TSP).

The diamond tables 234*a,b* may be made of a variety of ultra-hard materials including, but not limited to, polycrystalline diamond (PCD), thermally stable polycrystalline diamond (TSP), cubic boron nitride, impregnated diamond, nanocrystalline diamond, ultra-nanocrystalline diamond, and zirconia. Such materials are extremely wear-resistant and are suitable for use as bearing surfaces, as herein described.

The rolling element 204 may comprise and otherwise include one or more cylindrical bearing portions. More particularly, in this example, the entire rolling element 204 is cylindrical and made of hard, wear-resistant materials, and thus any portion of the rolling element 204 may be considered as a cylindrical bearing portion to the extent it slidingly engages a bearing surface of the inner chamber 216 or another component part of the rolling element assembly 200 when rolling, such as would be expected during drilling operations. In some embodiments, for instance, one or both of the diamond tables 234*a,b* may be considered cylindrical bearing portions for the rolling element 204. In other embodiments, one or both of the diamond tables 234*a,b* may be omitted from the rolling element 204 and the substrate 232 may alternatively be considered as a cylindrical bearing portion. In yet other embodiments, the entire cylindrical or disk-shaped rolling element 204 may be considered as a cylindrical bearing portion and may be made of any of the hard or ultra-hard materials mentioned herein, without departing from the scope of the disclosure.

It should be noted that the features of the rolling element 204 are shown for illustrative purposes only and may or may not be drawn to scale. Consequently, the rolling element 204 as depicted should not be considered as limiting the scope of the present disclosure. For example, the thickness or axial extent of both the diamond tables 234*a,b* may or may not be the same. In at least one embodiment, one of the diamond tables 234*a,b* may be thicker than the other. Moreover, in some embodiments, one of the diamond tables 234*a,b* may be omitted from the rolling element 204 altogether. In yet other embodiments, the substrate 232 may be omitted and the rolling element 204 may instead be made entirely of the material of the diamond tables 234*a,b*.

The support members 206*a,b* can comprise mirror images of each other and provide generally arcuate (e.g., curved) bodies that provide an inner arcuate surface 236*a* and an outer arcuate surface 236*b* opposite the inner arcuate surface 236*a*. The support members 206*a,b* can be made of any of the hard or ultra-hard materials mentioned herein. More specifically, the support members 206*a,b* may be made of a material such as, but not limited to, steel, a steel alloy, tungsten carbide, a sintered tungsten carbide composite structure, cemented carbide, polycrystalline diamond (PCD), thermally stable polycrystalline diamond (TSP), cubic boron nitride, impregnated diamond, nanocrystalline diamond, ultra-nanocrystalline diamond, zirconia, any derivatives thereof, and any combinations thereof. Alternatively, or in addition thereto, the support members 206*a,b* may be made of an engineering metal, a coated material (i.e., using processes such as chemical vapor deposition, plasma vapor deposition, etc.), or other hard or abrasion-resistant materials.

The support members 206*a,b* are configured to be extended (inserted) through the first and second arcuate slots 224*a,b* during installation. When assembled in the housing 202, the support members 206*a,b* will interpose the rolling element 204 and the support base 208, and during operation a portion of the inner arcuate surface 236*a* of each support member 206*a,b* will engage or otherwise be disposed adjacent the outer circumferential surface of the rolling element 204. Accordingly, the support members 206*a,b* may serve as a bearing surface that supports and guides the rolling element 204 and may assume most (if not all) of the load exerted on the rolling element 204.

Given the design of the rolling element assembly 200, the force exerted on the support members 206*a,b* during operation may be primarily compressive in nature. Having the support members 206*a,b* made of a hard or ultra-hard material may help reduce the amount of friction and wear between the rolling element 204 and the support members 206*a,b* as the rolling element 204 bears and slides against the inner arcuate surface 236*a*. Consequently, the hard or ultra-hard materials of the support members 206*a,b* may reduce or eliminate the need for lubrication between the support members 206*a,b* and the rolling element 204. In at least one embodiment, however, the inner arcuate surface 236*a* of one or both of the support members 206*a,b* may be polished so as to reduce friction between the opposing surfaces. The inner arcuate surfaces 236*a* may be polished, for example, to a surface finish of about 40 micro-inches or better.

The support base 208 may be made of any of the hard or ultra-hard materials mentioned herein. Moreover, the support base 208 provides and otherwise defines an upper arcuate surface 238*a* and a generally flat or planar bottom surface 238*b* opposite the upper arcuate surface 238*a*. When the support base 208 is assembled in the housing 202, the planar bottom surface 238*b* will be generally flush with the bottom surface 212*b* of the housing 212 and the upper arcuate surface 238*a* will engage or otherwise be disposed adjacent the outer arcuate surfaces 236*b* of the support members 206*a,b*. Accordingly, the support base 208 may serve to support the support members 206*a,b* and the rolling element 204 within the housing 202 during operation.

The locking element 210 may comprise a wire-like or slender structure that exhibits a generally polygonal (e.g., square, rectangular, etc.) cross-sectional shape capable of being inserted into the correspondingly-shaped lock apertures 226*a,b*. The locking element 210 provides a first end 240*a* and a second end 240*b* (partially occluded behind the rolling element 204) opposite the first end 240*a*. As illustrated, the first end 240*a* may be tapered, which may prove advantageous in helping separate the support members 206*a,b* as the locking element 210 is advanced into the housing 202 via one of the lock apertures 226*a,b*.

The locking element 210 may be made of a variety of materials including, but not limited to, mild steel, a low-temperature metal, a shaped memory metal, spring steel, a polymer (e.g., PEEK), any combination thereof, or any malleable metal. As it is advanced into one of the lock apertures 226*a,b*, the locking element 210 may plastically (or elastically) deform into a generally arcuate shape that generally matches the arcuate curvature of the inner chamber 216. In other embodiments, however, the locking element 210 may be made of any of the hard or ultra-hard materials mentioned above for the substrate 232 and the diamond tables 234*a,b*. In such embodiments, the locking element 210 may be formed as an arcuate-shaped body (i.e., circular with no tangent trajectories) capable of being extended (rotated) into one of the lock apertures 226*a,b* during installation.

Figure 3:
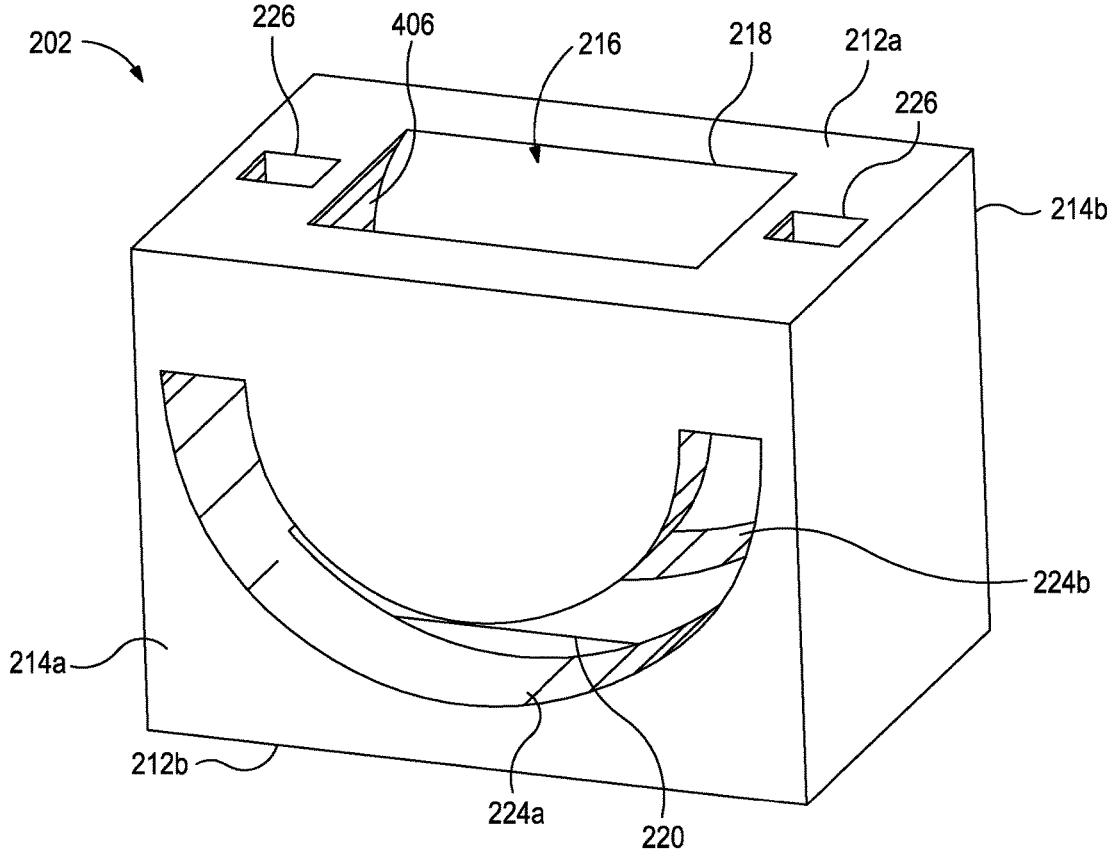
FIG. 3 is an isometric view of the housing of the rolling element assembly of FIG. 2.

FIG. 3 is an isometric view of the housing 202 of the rolling element assembly 200 of FIG. 2, according to one or more embodiments. As discussed above, the generally cube-shaped housing 202 includes the top and bottom surfaces 212*a,b* and the first and second lateral sides 214*a,b*. The opening 218 is defined in the top surface 212*a* and the inner chamber 216 extends from the opening 218 and into the interior of the housing 202. Moreover, the lock apertures 226 are also defined in the top surface 212*a* and shaped (sized) to receive the locking element 210 (FIG. 2). The first and second arcuate slots 224*a,b* are also shown as being defined on the opposing first and second lateral sides 214*a,b* respectively. As indicated above, the first and second arcuate slots 224*a,b* may alternatively be characterized as a single arcuate slot defined through the body of the housing 202 and extending continuously between the first and second lateral sides 214*a,b*. Lastly, a portion of the support opening 220 is visible through the first arcuate slot 224*a* and defined in the bottom surface 212*b*.

Figure 4A:
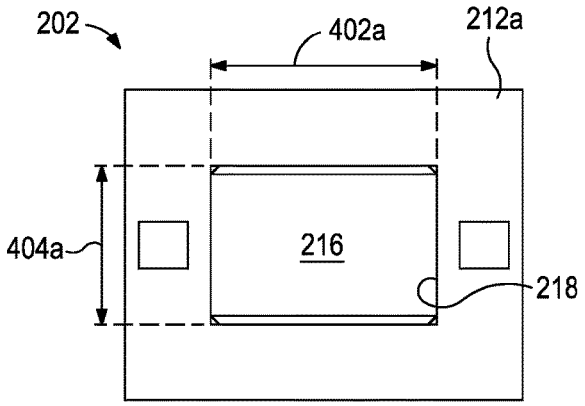
FIGS. 4A and 4B are top and bottom views, respectively of the housing of FIG. 3.
Figure 4B:
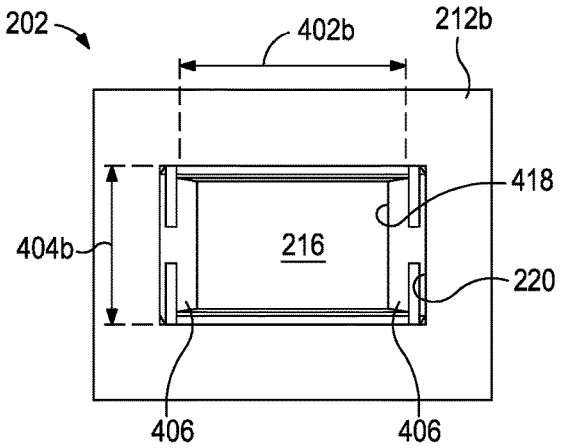

FIGS. 4A and 4B are top and bottom views, respectively of the housing 202 of FIGS. 2 and 3, according to one or more embodiments. More specifically, FIG. 4A depicts the top surface 212*a* of the housing 202 and FIG. 4B depicts the bottom surface 212*b* of the housing 202. As illustrated, the opening 218 in the top surface 212*a* and the support opening 220 in the bottom surface 212*b* may each exhibit a generally rectangular shape. In the illustrated embodiment, the opening 218 exhibits a first length 402*a* and a first width 404*a*, and the support opening 220 exhibits a second length 402*b* and a second width 404*b*.

The length 402*b* of the support opening 220 is greater than the length 402*a* of the opening 218 and is at least as long as the diameter of the rolling element 204 (FIG. 2), whereas the length 402*a* of the opening 218 is less than the diameter of the rolling element 204. Consequently, the rolling element 204 may be able to fit into the housing 202 via the support opening 220, but the opening 218 on the top surface 212*a* will prevent the rolling element 204 from escaping the housing 202. Rather, an arcuate portion of the rolling element 204 will extend out of the opening 218 when the rolling element assembly 200 (FIG. 2) is fully assembled. Moreover, the walls 406 (best seen in FIG. 4B) of the inner chamber 216 at the opening 218 may be configured to encircle more than 180° of the circumference of the rolling element 204, but less than 360°, so that the full axial width 230 (FIG. 2) of the rolling element 204 remains exposed for external contact with a formation during operation.

In some embodiments, the first and second widths 404*a,b* may be substantially similar, but may alternatively be different where the width 404*b* of the support opening 220 may be greater than the width 404*a* of the opening 218. The first and second widths 404*a,b* are each at least as wide as the axial width 230 (FIG. 2) of the rolling element 204 (FIG. 2). This allows the rolling element 204 to be introduced into the housing 202 via the support opening 220 and also have an arcuate portion of the rolling element 204 extend out of the opening 218 when the rolling element assembly 200 (FIG. 2) is fully assembled.

Figure 5A:
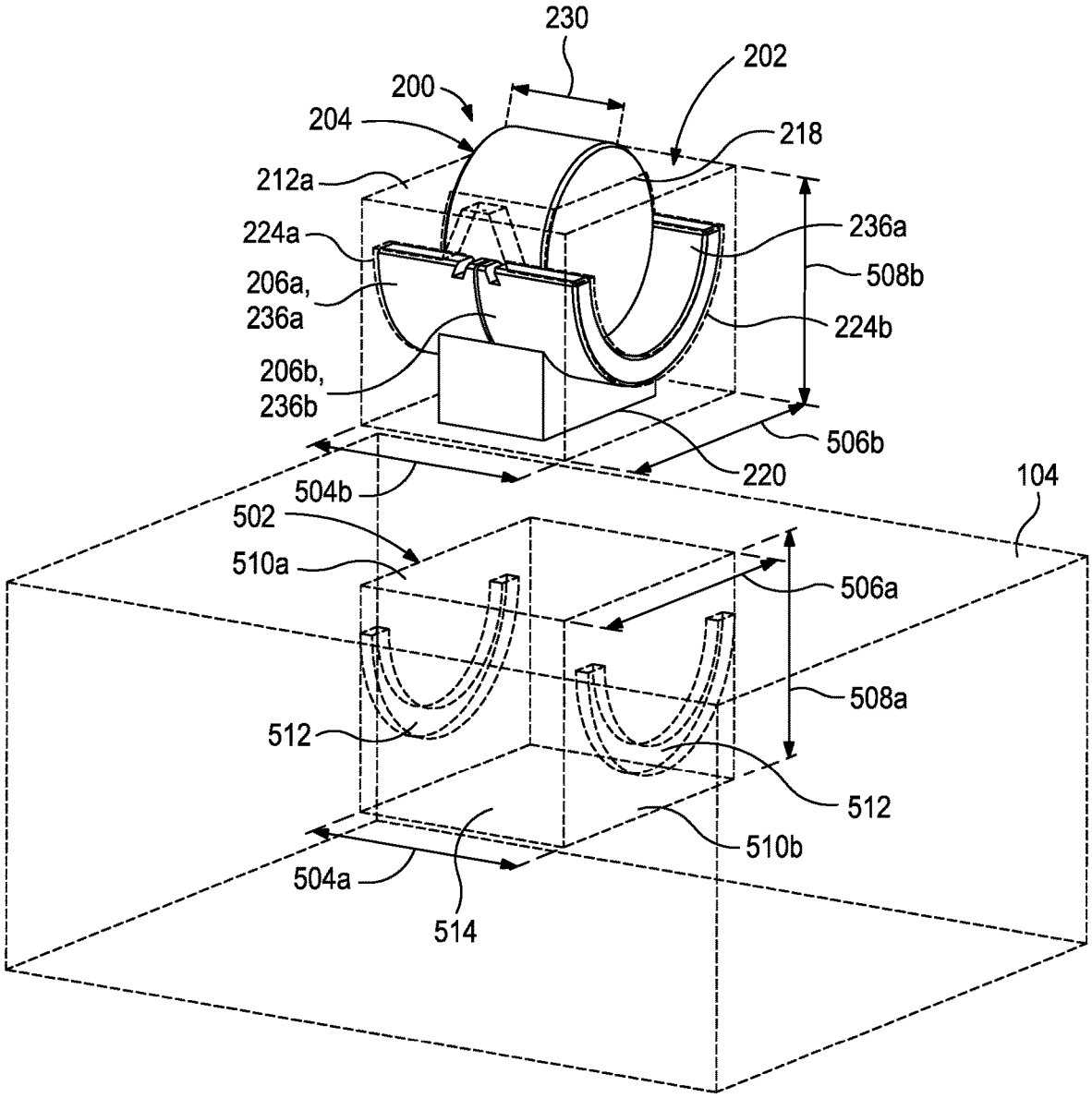
FIGS. 5A-5C are progressive isometric views depicting the assembly of the rolling element assembly of FIG. 2 and installation within a cavity defined in a blade of a drill bit.
Figure 5B:
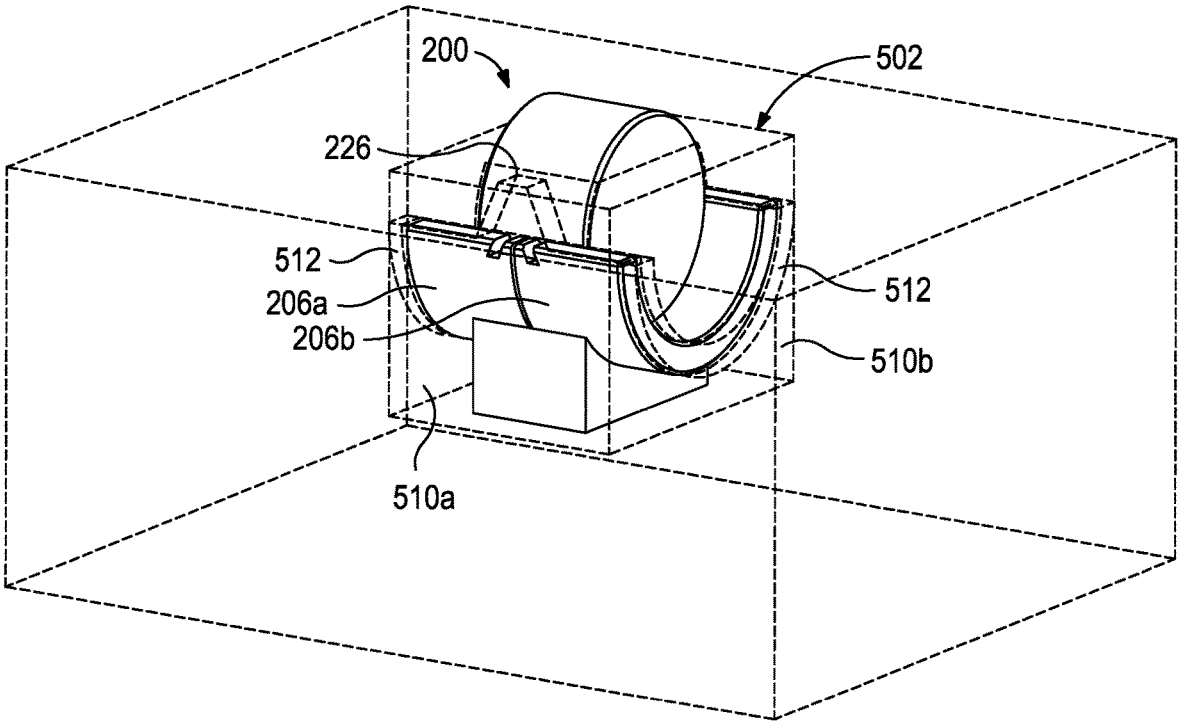
Figure 5C:
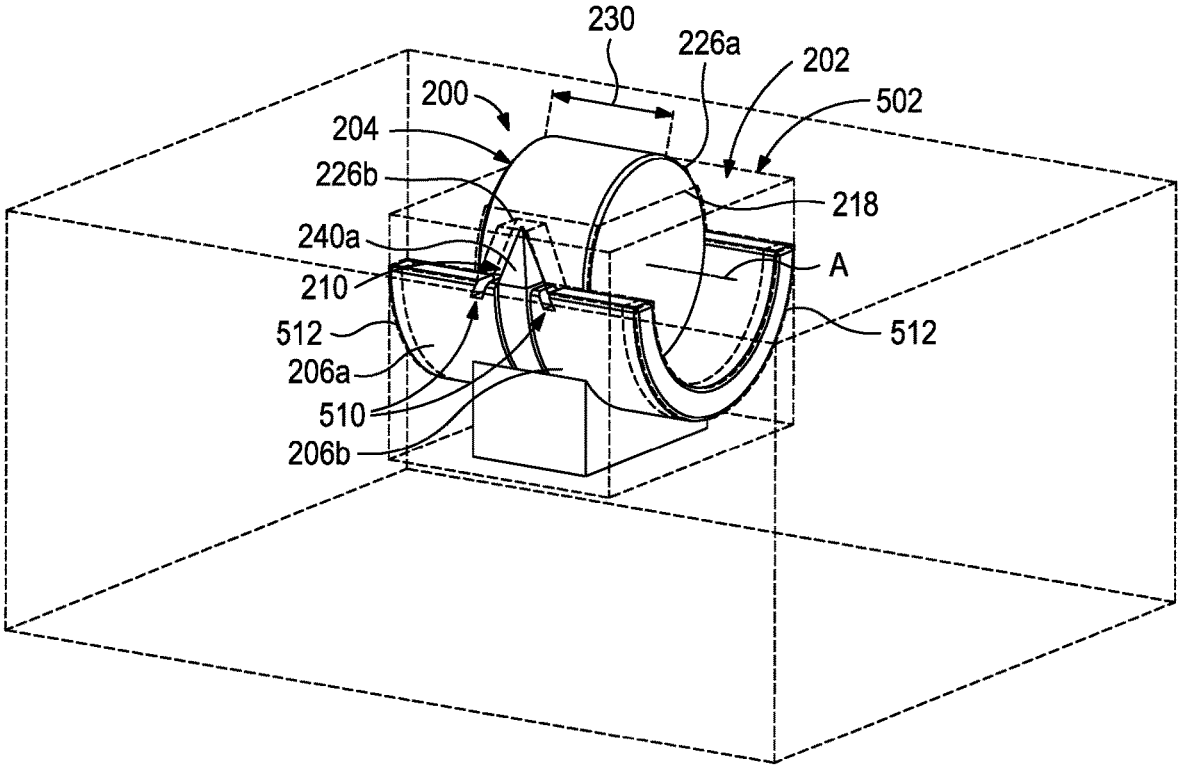

FIGS. 5A-5C are progressive isometric views that depict assembly of the rolling element assembly 200 and its subsequent installation within a cavity 502 defined in a blade 104 of the drill bit of FIGS. 1A-1B. While the cavity 502 is shown as being defined in the blade 104, it will be appreciated that the principles of the present disclosure are equally applicable to the cavity 502 being defined on other locations of the drill bit 100, without departing from the scope of the disclosure. The housing 202 and the blade 104 are each depicted in FIGS. 5A-5C in phantom (i.e., dashed linetype) to allow the component parts of the rolling element assembly 200 to be viewed during assembly and installation. Moreover, only a portion of the blade 104 is represented in FIGS. 5A-5C and depicted in the general shape of a cube, whereas the blade 104 would alternatively comprise other shapes and be much larger in size.

In FIG. 5A, the cavity 502 is defined as a generally cubic structure having dimensions configured to receive the rolling element assembly 200 and, more specifically to receive the housing 202. In particular, the cavity 502 exhibits a first length 504*a*, a first width 506*a*, and a first depth 508*a*, while the housing 202 exhibits a second length 504*b*, a second width 506*b*, and a second depth 508*b*. To be able to receive the housing 202 within the cavity 502, the first length 504*a* and the first width 506*a* may be greater than the second length 504*b* and the second width 506*b*, respectively. In some embodiments, the first and second depths 508*a,b* may be substantially similar such that when the housing 202 is received within the cavity 502, the top surface 212*a* of the housing 202 will be substantially flush with the outer surface of the blade 104.

The cavity 502 may provide a first sidewall 510*a* and a second sidewall 510*b* opposite the first sidewall 510*a*. An arcuate groove 512 may be defined into each sidewall 510*a,b*, and each arcuate groove 512 is configured to receive an axial end of a corresponding one of the support members 206*a,b*, as described below. Accordingly, the radius of curvature of the arcuate grooves 512 may be substantially similar to the radius of curvature of the support members 206*a,b* and the first and second arcuate slots 224*a,b*.

In embodiments where the drill bit 100 (FIGS. 1A-1B) is made of a matrix material, the cavity 502 and the arcuate grooves 512 may be formed by selectively placing displacement materials (i.e., consolidated sand or graphite) at the location where the cavity 502 and the arcuate grooves 512 are to be formed. In embodiments where the drill bit 100 comprises a steel body drill bit, conventional machining techniques may be employed to machine the cavity 502 and the arcuate grooves 512 to desired dimensions.

Example assembly of the rolling element assembly 200 is now provided. The rolling element assembly 200 may be assembled by first extending (inserting) the rolling element 204 into the housing 202 via the support opening 220 and advancing the rolling element 204 into the interior of the housing 202 until it is received within the inner chamber 216 (FIGS. 2, 3, and 4A-4B). The first and second arcuate support members 206*a,b* are then extended (inserted) into the first and second arcuate slots 224*a,b*, respectively, and advanced into the interior of the housing 202 until their opposing axial ends come into contact with each other. As the support members 206*a,b* are extended into the housing 202, the rolling element 204 is received and supported by the inner arcuate surface 236*a* of each support member 206*a,b*. As a result, a portion of the inner arcuate surface 236*a* of each support member 206*a,b* will engage the outer circumferential surface of the rolling element 204.

In some embodiments, the total axial length of the support members 206*a,b* as touching axial sides (ends) will be equal to or less than the length 504*b* of the housing 202. Consequently, when the support members 206*a,b* are extended into the housing 202 and engaging each other, the outer axial ends of the support members 206*a,b* will not extend out of the first and second arcuate slots 224*a,b* on either side. In other embodiments, however, the total axial length of the support members 206*a,b* as touching axial sides may be greater than the length 504*b*, and the ends of the support members 206*a,b* extending out of the first and second arcuate slots 224*a,b* on either side may be machined off after insertion. As will be appreciated, this will allow the housing 202 to be inserted into the cavity 502 without the support members 206*a,b* binding on any of the walls of the cavity 502.

The support base 208 may then be extended (inserted) through the support opening 220 and into the support cavity 222 (FIG. 2). The support base 208 may exhibit dimensions smaller than that of the support opening 220 to allow the support base 208 to pass through the support opening 220 and be received within the support cavity 222. When the support base 208 is properly received within the support cavity 222, the planar bottom surface 238*b* (FIG. 2) will be generally flush with the bottom surface 212*b* of the housing 202 and the upper arcuate surface 238*a* (FIG. 2) of the support base 208 will engage the outer arcuate surfaces 236*b* of the support members 206*a,b*. When the rolling element assembly 200 is received within the cavity 502, the planar bottom surface 238*b* and the bottom surface 212*b* of the housing 202 will bear against a bottom 514 of the cavity 502. Accordingly, the support base 208 may serve to support the support members 206*a,b* and the rolling element 204 within the cavity 502 during operation.

With the rolling element 204, the support members 206*a,b*, and the support base 208 properly received within the housing 202, as generally described above, an arcuate portion of the rolling element 204 will extend through the opening 218 out of the housing 202 and expose the full axial width 230 of the rolling element 204. The housing 202 at the opening 218 encircles more than 180° of the circumference of the rolling element 204, but less than 360° so that the full axial width 230 of the rolling element 204 remains exposed for external contact with a formation during operation. The housing 202 may then be placed inside the cavity 502 and prepared to be secured within the cavity 502 for downhole use.

FIG. 5B shows the rolling element assembly 200 as inserted into or otherwise received by the cavity 502. As illustrated, with the housing 202 received within the cavity 502, the support members 206*a,b* and the arcuate grooves 512 defined on the opposing sidewalls 510*a,b* of the cavity 502 may be substantially aligned. The support members 206*a,b*, however, may be positioned within the confines of the housing 202 and otherwise not extended into the arcuate grooves 512. To secure the rolling element assembly 200 within the cavity 502, the support members 206*a,b* are extended laterally into the corresponding arcuate grooves 512. This may be accomplished by extending (inserting) the locking element 210 (FIG. 2) into one of the lock apertures 226 (only one shown in FIG. 5B) and advancing the locking element 210 into the interior of the housing 202.

FIG. 5C shows the locking element 210 as having been extended (inserted) into the first lock aperture 226*a* (partially occluded behind the rolling element 204) and advanced into the interior of the housing 202 until reaching or approaching the opening to the second lock aperture 226*b*. The tapered first end 240*a* of the locking element 210 may prove advantageous in allowing the locking element 210 to separate and urge the support members 206*a,b* laterally and into the opposing arcuate grooves 512 as the locking element 210 advances into the housing 202. In some embodiments, edges of the support members 206*a,b* may be chamfered or angled to help facilitate the tapered first end 240*a* to more easily extend between and separate the support members 206*a,b*.

In some embodiments, the locking element 210 may be forced into the housing 202 under pressure or mechanical force (e.g., striking the locking element 210 with a hammer or the like). The locking element 210, for example, may exhibit a geometry that results in an interference fit between the opposing support members 206*a,b* when forced into the arcuate grooves 512. In other embodiments, however, the locking element 210 may be secured within the housing via a thermal shrink-fit.

In some embodiments, as illustrated, the locking element 210 may be advanced toward the opposing lock aperture 226 (i.e., the second lock aperture 226*b*) but not extend out of the lock aperture 226. In other embodiments, one or both of the ends of the locking element 210 may extend out of the lock apertures 226*a,b* and may be subsequently machined off once the locking element 210 is properly extended into the housing 202. Because of the generally U-shaped engagement between the housing 202, the support members 206*a,b*, and the arcuate grooves 512, a strong, bulky locking engagement results that allows the housing 202 to sustain large loading forces without failure of the housing 202 or the cavity 502.

The locking element 210 and the inner arcuate surface 236*a* (FIG. 2) of each support member 206*a,b* may exhibit a matching arcuate profile. In other words, the support members 206*a,b* and the geometry of the locking element 210 are designed such that the curvature of the inner arcuate surfaces 236*a* will transition smoothly to the curvature of the locking element 210 to enable the rolling element 204 to bear against a continuously (uniform) curved surface at all angular locations within the cavity 502 during operation. As a result, the locking element 210 may be used not only for locking purposes, but also as a bearing support as engaged against the outer circumference of the rolling element 204. If there is any deformation on the opposing arcuate surface of the locking element 210 due to vibration of the rolling element 204 during use, such deformation may enhance the interference fit provided by the locking element 210. Consequently, inadvertent disengagement of the locking element 210 from the housing 202 during use is less likely with increased loading on the rolling element 204.

During drilling operations, the rolling element 204 is able to rotate within the housing 202 (i.e., the inner chamber 216 of FIG. 2) about the rotational axis A of the rolling element 204. As the rolling element 204 rotates about the rotational axis A, the arcuate portion of the rolling element 204 extends out of the housing 202 and through the opening 218 to engage (i.e., cut, roll against, or both) an underlying formation. This allows the full axial width 230 of the rolling element 204 across the entire outer circumferential surface to progressively be used as the rolling element 204 rotates during use.

Figure 6A:
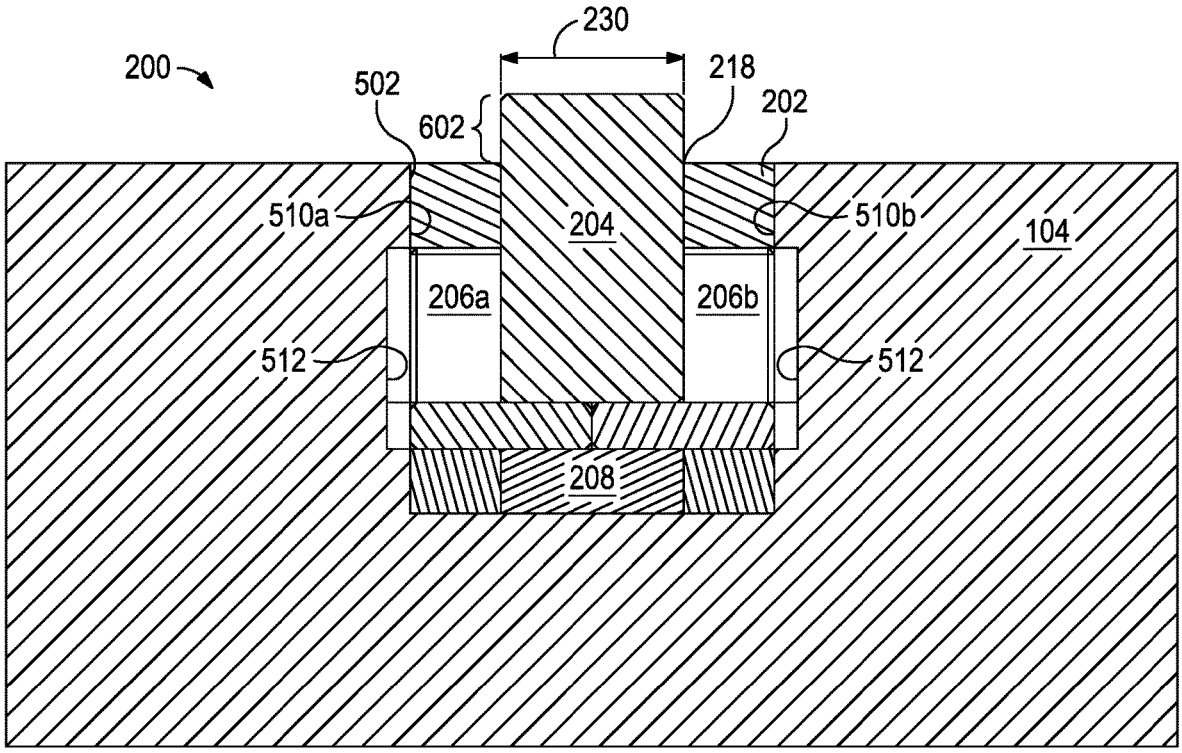
FIGS. 6A and 6B are cross-sectional side views of the rolling element assembly of FIG. 2 being installed within a cavity of a blade.
Figure 6B:
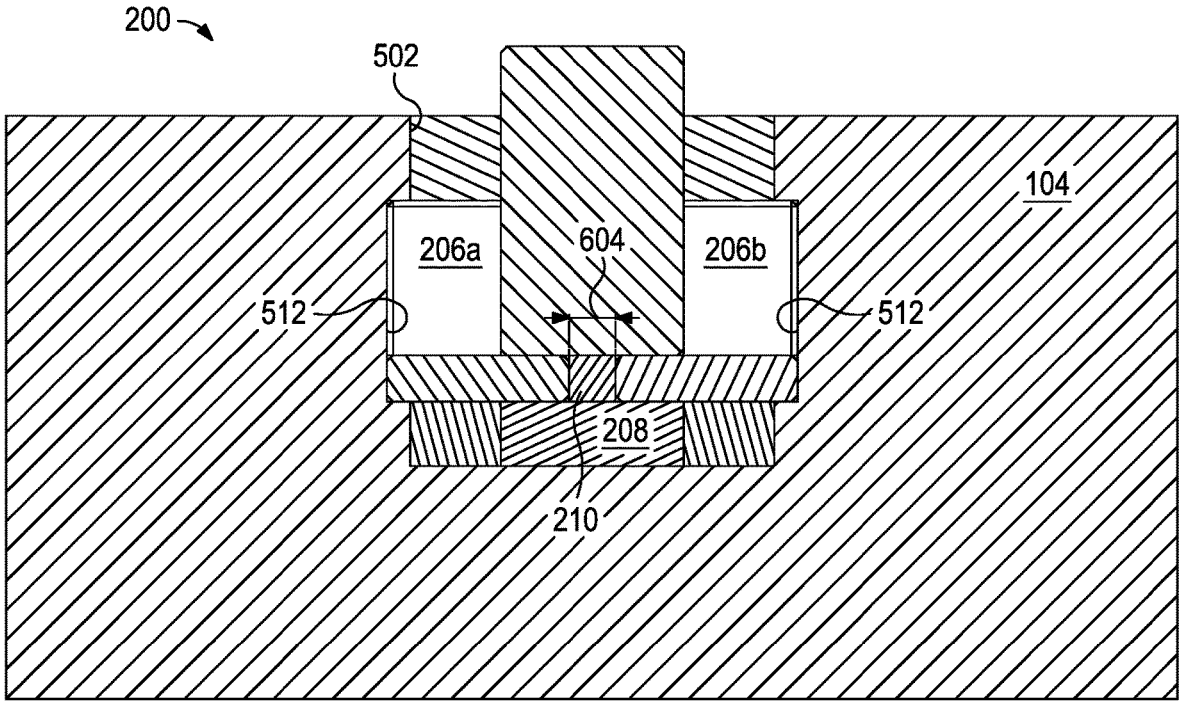

FIGS. 6A and 6B are cross-sectional side views of the rolling element assembly 200 during installation within the cavity 502 defined in the blade 104. In FIG. 6A, the housing 202 is received within the cavity 502 and includes the rolling element 204, the support members 206*a,b*, and the support base 208 properly received therein, as generally described above. As illustrated, an arcuate portion 602 of the rolling element 204 extends through the opening 218 and out of the housing 202 and thereby exposes the full axial width 230 of the rolling element 204. Moreover, in FIG. 6A, the support members 206*a,b* are positioned within the confines of the housing 202 and otherwise not extended into the arcuate grooves 512 provided on the opposing sidewalls 510*a,b* of the cavity 502.

In FIG. 6B, the locking element 210 is shown as extended into the housing 202 to secure the rolling element assembly 200 within the cavity 502, as generally described above. As it advances into the housing 202, the locking element 210 separates and urges the support members 206*a,b* laterally to be received within the opposing arcuate grooves 512. In some embodiments, the depth of each arcuate groove 512 may be half the width 604 of the locking element 210 or slightly smaller to enable an interference fit between the locking element 210 and the support members 206*a,b*. Potential horizontal movement of the rolling element assembly 200 within the cavity 502 is prevented by the support members 206*a,b* extended laterally into the arcuate grooves 512.

Referring again to FIG. 5C, after some time, it may be desired to remove the rolling element assembly 200 from the cavity 502 for rehabilitation or replacement. The rolling element assembly 200 may be removed from the cavity 502 by first removing the locking element 210. This may be accomplished by reversing the locking element 210 out of the lock apertures 226 by driving (forcing) the locking element 210 via one of the lock apertures 226. Once a portion of the locking element 210 is exposed, the locking element 210 may be gripped with a pair of pliers or the like and fully reversed out and removed.

Once the locking element 210 is removed, the support members 206*a,b* will have to be laterally contracted and otherwise cleared from the arcuate grooves 512 to enable the housing 202 to be removed from the cavity 502. Clearing the support members 206*a,b* from the arcuate grooves 512 may be accomplished via a variety of methods or means. In some embodiments, for example, the support members 206*a,b* may each define or otherwise provide an extraction feature 510 that may be used to help move the support members 206*a,b* laterally out of engagement with the arcuate grooves 512 once the locking element 210 is removed.

Figure 7:
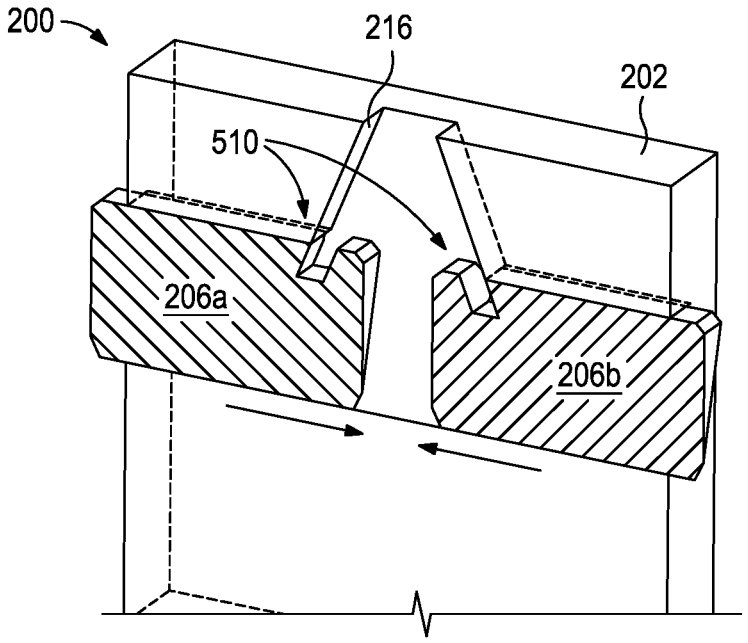
FIG. 7 is an enlarged, cross-sectional side view of a portion of the rolling element assembly of FIG. 2 showing an example extraction feature.

FIG. 7 is an enlarged, cross-sectional side view of a portion of the rolling element assembly 200 showing one example of the extraction feature 510, according to one or more embodiments. The extraction feature 510 may comprise any negative or positive alteration in the geometrical shape of the support members 206*a,b* that provides a location where the support members 206*a,b* may be gripped or otherwise engaged to move the support members 206*a,b* laterally out of the arcuate grooves 512 (FIG. 5C) and back into the confines of the housing 202. Negative alterations, for example, comprise material removal from the support members 206*a,b*, while positive alterations comprise material additions to the support members 206*a,b*. In the illustrated embodiment, the extraction feature 510 comprises a negative alteration in the form of a slot, a groove, or a channel defined on the end of each support member 206*a,b*.

When it is desired to remove the support members 206*a,b* from the arcuate grooves 512 (FIG. 5C) and back into the confines of the housing 202, a user may access and engage the extraction feature 510 with a rigid contrivance (e.g., pliers, a pick, a screwdriver, a rigid rod, etc.) and move the support members 206*a,b* laterally toward each other, as indicated by the arrows. In at least one embodiment, as illustrated, the lock aperture 226 may be tapered and otherwise grooved as it extends into the housing 202 to enable a user to access the extraction feature 510 and thereby gain leverage over the support members 206*a,b* to move them laterally.

Figure 8:
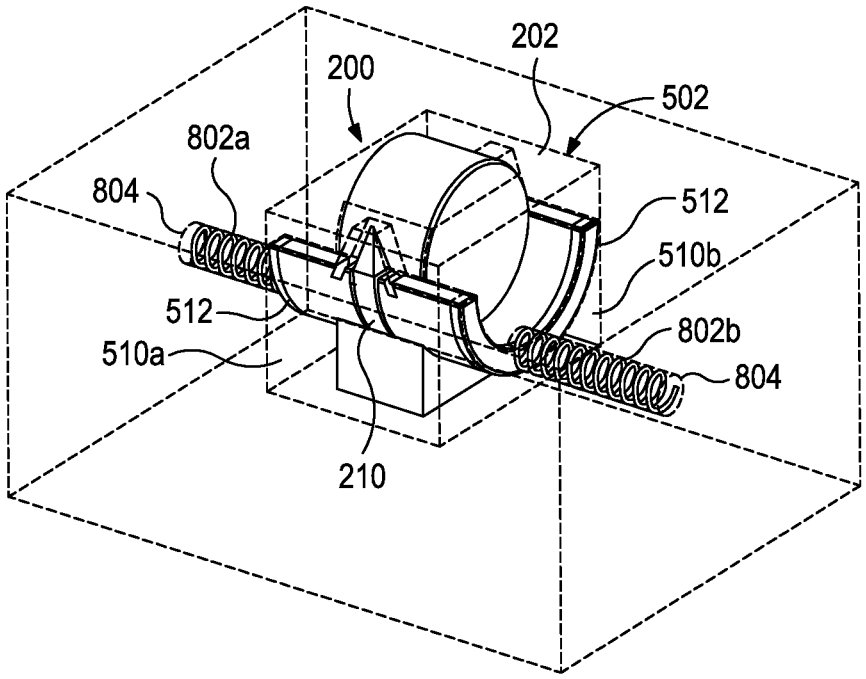
FIG. 8 is an isometric view of an alternative embodiment of the rolling element assembly of FIG. 2.

FIG. 8 is an isometric view of an alternative embodiment of the rolling element assembly 200 that provides an alternative means of removing the rolling element assembly 200 when desired. More specifically, in some embodiments, the rolling element assembly 200 may further include a first biasing device 802*a* and a second biasing device 802*b* used to urge (bias) the support members 206*a,b* toward the interior of the housing 202. In some embodiments, as illustrated, the biasing devices 802*a,b* may comprise compression springs. In other embodiments, however, the biasing devices 802*a,b* may comprise a series of Belleville washers, or the like.

A device cavity 804 may be defined in the blade 104, and each device cavity 804 may be configured to receive a corresponding one of the biasing devices 802*a,b* to act on the support members 206*a,b*. As illustrated, the device cavities 804 are laterally aligned with and extend into the arcuate grooves 512. Consequently, the devices cavities 804 may be able to align the biasing devices 802*a,b* with the support members 206*a,b*. When the locking element 210 extends into the housing 202 and thereby separates and urges the support members 206*a,b* laterally into the opposing arcuate grooves 512, the support members 206*a,b* will laterally engage and compress the opposing first and second biasing devices 802*a,b*, which builds spring force in each biasing device 802*a,b*. When the locking element 210 is subsequently removed to extract the rolling element assembly 200 from the cavity 502, the spring force of the biasing devices 802*a,b* will act on the support members 206*a,b* and force the support members 206*a,b* back into the confines of the housing 202 and otherwise out of the arcuate grooves 512. With the support members 206*a,b* removed from the arcuate grooves 512, the housing 202 and its internal components may be extracted from the cavity 502.

Embodiments disclosed herein include:

A. A drill bit that includes a bit body including one or more blades extending therefrom, a plurality of cutters secured to the one or more blades, and a rolling element assembly positioned within a cavity defined on the bit body, the rolling element assembly including a housing, a rolling element rotatable within the housing about a rotational axis, and one or more bearing elements extendable into a corresponding one or more arcuate grooves defined in the cavity to secure the housing within the cavity, wherein the housing encircles more than 180° but less than 360° of a circumference of the rolling element while leaving a full axial width of the rolling element exposed.

B. A rolling element assembly that includes a housing receivable within a cavity defined in a bit body of a drill bit, the housing providing an opening defined in a top surface of the housing, a rolling element rotatable about a rotational axis and having an arcuate portion extend out of the opening when positioned within the housing, wherein the housing encircles more than 180° but less than 360° of a circumference of the rolling element while leaving a full axial width of the rolling element exposed, and one or more bearing elements positionable within the housing to support the rolling element and extendable into a corresponding one or more arcuate grooves defined in the cavity.

Each of embodiments A and B may have one or more of the following additional elements in any combination: Element 1: wherein the one or more bearing elements comprise a material selected from the group consisting of steel, a steel alloy, tungsten carbide, a sintered tungsten carbide composite, cemented carbide, polycrystalline diamond, thermally stable polycrystalline diamond, cubic boron nitride, impregnated diamond, nanocrystalline diamond, ultra-nanocrystalline diamond, zirconia, any derivatives thereof, and any combination thereof. Element 2: wherein the one or more bearing elements comprise a first bearing element and a second bearing element, and the housing further comprises an inner chamber defined within the housing and sized to receive the rolling element, an opening defined in a top surface of the housing through which an arcuate portion of the rolling element extends, a support opening defined in a bottom surface of the housing, a first arcuate slot defined on a first lateral side of the housing, and a second arcuate slot defined on a second lateral side of the housing, wherein the first and second bearing elements are extendable within the housing via the first and second arcuate slots, respectively. Element 3: wherein the rolling element assembly further comprises a support base extendable within the housing via the support opening, and a locking element extendable within the housing via a lock aperture defined in the top surface, wherein the locking element separates and moves the first and second support members into the arcuate grooves to secure the housing within the cavity. Element 4: wherein the first and second support members each comprise an arcuate body having an inner arcuate surface and an outer arcuate surface opposite the inner arcuate surface, and wherein the first and second support members interpose the rolling element and the support base when installed in the housing such that a portion of the inner arcuate surface of each support member engages an outer circumferential surface of the rolling element, and a portion of the outer arcuate surface of each support member engages an upper arcuate surface of the support base. Element 5: wherein a length of the support opening is greater than a diameter of the rolling element and a length of the opening is less than the diameter of the rolling element. Element 6: further comprising an extraction feature provided on one or both of the support members and accessible via a lock aperture defined in a top surface of the housing. Element 7: wherein the first and second arcuate grooves are defined in opposing first and second sidewalls, respectively, of the cavity, the drill bit further comprising a first device cavity defined in the bit body and extending into the first arcuate groove, a second device cavity defined in the bit body and extending into the second arcuate groove, a first biasing device arranged within the first device cavity and engageable with the first support member, and a second biasing device arranged within the second device cavity and engageable with the second support member. Element 8: wherein the cavity is defined on the one or more blades. Element 9: wherein the rotational axis of the rolling element lies on a plane that passes through a longitudinal axis of the bit body. Element 10: wherein the rotational axis of the rolling element lies on a plane that is perpendicular to a longitudinal axis of the bit body. Element 11: wherein the rotational axis of the rolling element lies on a plane that is neither perpendicular to nor passes through a longitudinal axis of the bit body.

Element 12: wherein the one or more bearing elements comprise a first bearing element and a second bearing element, and the housing further comprises an inner chamber defined within the housing to receive the rolling element, a support opening defined in a bottom surface of the housing, a first arcuate slot defined on a first lateral side of the housing, and a second arcuate slot defined on a second lateral side of the housing, wherein the first and second bearing elements are extendable within the housing via the first and second arcuate slots, respectively. Element 13: further comprising a support base extendable within the housing via the support opening, and a locking element extendable within the housing via a lock aperture defined in the top surface, wherein the locking element separates and moves the first and second support members into the arcuate grooves to secure the housing within the cavity. Element 14: wherein the first and second support members each comprise an arcuate body having an inner arcuate surface and an outer arcuate surface opposite the inner arcuate surface, and wherein the first and second support members interpose the rolling element and the support base when installed in the housing such that a portion of the inner arcuate surface of each support member engages an outer circumferential surface of the rolling element, and a portion of the outer arcuate surface of each support member engages an upper arcuate surface of the support base. Element 15: wherein the first and second support members and the locking element cooperatively support the rolling element during rotation. Element 16: wherein a length of the support opening is greater than a diameter of the rolling element and a length of the opening is less than the diameter of the rolling element. Element 17: further comprising an extraction feature provided on one or both of the support members and accessible via a lock aperture defined in a top surface of the housing. Element 18: wherein the first and second arcuate grooves are defined in opposing first and second sidewalls, respectively, of the cavity, the drill bit further comprising a first device cavity defined in the bit body and extending into the first arcuate groove, a second device cavity defined in the bit body and extending into the second arcuate groove, a first biasing device arranged within the first device cavity and engageable with the first support member, and a second biasing device arranged within the second device cavity and engageable with the second support member.

By way of non-limiting example, exemplary combinations applicable to A and B include: Element 2 with Element 3; Element 3 with Element 4; Element 2 with Element 5; Element 12 with Element 13; Element 12 with Element 14; Element 14 with Element 15; and Element 13 with Element 16.

Therefore, the disclosed systems and methods are well adapted to attain the ends and advantages mentioned as well as those that are inherent therein. The particular embodiments disclosed above are illustrative only, as the teachings of the present disclosure may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative embodiments disclosed above may be altered, combined, or modified and all such variations are considered within the scope of the present disclosure. The systems and methods illustratively disclosed herein may suitably be practiced in the absence of any element that is not specifically disclosed herein and/or any optional element disclosed herein. While compositions and methods are described in terms of "comprising," "containing," or "including" various components or steps, the compositions and methods can also "consist essentially of" or "consist of" the various components and steps. All numbers and ranges disclosed above may vary by some amount. Whenever a numerical range with a lower limit and an upper limit is disclosed, any number and any included range falling within the range is specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values. Also, the terms in the claims have their plain, ordinary meaning unless otherwise explicitly and clearly defined by the patentee. Moreover, the indefinite articles "a" or "an," as used in the claims, are defined herein to mean one or more than one of the elements that it introduces. If there is any conflict in the usages of a word or term in this specification and one or more patent or other documents that may be incorporated herein by reference, the definitions that are consistent with this specification should be adopted.

As used herein, the phrase "at least one of" preceding a series of items, with the terms "and" or "or" to separate any of the items, modifies the list as a whole, rather than each member of the list (i.e., each item). The phrase "at least one of" allows a meaning that includes at least one of any one of the items, and/or at least one of any combination of the items, and/or at least one of each of the items. By way of example, the phrases "at least one of A, B, and C" or "at least one of A, B, or C" each refer to only A, only B, or only C; any combination of A, B, and C; and/or at least one of each of A, B, and C.

What is claimed is:

1. A drill bit, comprising:

a bit body including one or more blades extending therefrom;

a plurality of cutters secured to the one or more blades; and a rolling element assembly positioned within a cavity defined on the bit body, the rolling element assembly including a housing, a rolling element rotatable within the housing about a rotational axis, and one or more bearing elements extendable into a corresponding one or more arcuate grooves defined in the cavity to secure the housing within the cavity, wherein the housing encircles more than 180° but less than 360° of a circumference of the rolling element while leaving a full axial width of the rolling element exposed.

2. The drill bit of claim 1, wherein the one or more bearing elements comprise a material selected from the group consisting of steel, a steel alloy, tungsten carbide, a sintered tungsten carbide composite, cemented carbide, polycrystalline diamond, thermally stable polycrystalline diamond, cubic boron nitride, impregnated diamond, nanocrystalline diamond, ultra-nanocrystalline diamond, zirconia, any derivatives thereof, and any combination thereof.

3. The drill bit of claim 1, wherein the one or more bearing elements comprise a first bearing element and a second bearing element, and the housing further comprises:

an inner chamber defined within the housing and sized to receive the rolling element;

an opening defined in a top surface of the housing through which an arcuate portion of the rolling element extends;

a support opening defined in a bottom surface of the housing;

a first arcuate slot defined on a first lateral side of the housing; and a second arcuate slot defined on a second lateral side of the housing, wherein the first and second bearing elements are extendable within the housing via the first and second arcuate slots, respectively.

4. The drill bit of claim 3, wherein the rolling element assembly further comprises:

a support base extendable within the housing via the support opening; and a locking element extendable within the housing via a lock aperture defined in the top surface, wherein the locking element separates and moves a first and second support members into the arcuate grooves to secure the housing within the cavity.

5. The drill bit of claim 4, wherein the first and second support members each comprise an arcuate body having an inner arcuate surface and an outer arcuate surface opposite the inner arcuate surface, and wherein the first and second support members interpose the rolling element and the support base when installed in the housing such that a portion of the inner arcuate surface of each support member engages an outer circumferential surface of the rolling element, and a portion of the outer arcuate surface of each support member engages an upper arcuate surface of the support base.

6. The drill bit of claim 4, further comprising an extraction feature provided on one or both of the first and second support members and accessible via a lock aperture defined in a top surface of the housing.

7. The drill bit of claim 3, wherein a length of the support opening is greater than a diameter of the rolling element and a length of the opening is less than the diameter of the rolling element.

8. The drill bit of claim 1, wherein the one or more arcuate grooves include first and second arcuate grooves defined in opposing first and second sidewalls, respectively, of the cavity, the drill bit further comprising:

a first device cavity defined in the bit body and extending into the first arcuate groove;

a second device cavity defined in the bit body and extending into the second arcuate groove;

a first biasing device arranged within the first device cavity and engageable with a first support member; and a second biasing device arranged within the second device cavity and engageable with a second support member.

9. The drill bit of claim 1, wherein the cavity is defined on the one or more blades.

10. The drill bit of claim 1, wherein the rotational axis of the rolling element lies on a plane that passes through a longitudinal axis of the bit body.

11. The drill bit of claim 1, wherein the rotational axis of the rolling element lies on a plane that is perpendicular to a longitudinal axis of the bit body.

12. The drill bit of claim 1, wherein the rotational axis of the rolling element lies on a plane that is neither perpendicular to nor passes through a longitudinal axis of the bit body.

13. A rolling element assembly, comprising:

a housing receivable within a cavity defined in a bit body of a drill bit, the housing providing an opening defined in a top surface of the housing;

a rolling element rotatable about a rotational axis and having an arcuate portion extend out of the opening when positioned within the housing, wherein the housing encircles more than 180° but less than 360° of a circumference of the rolling element while leaving a full axial width of the rolling element exposed; and one or more bearing elements positionable within the housing to support the rolling element and extendable into a corresponding one or more arcuate grooves defined in the cavity.

14. The rolling element assembly of claim 13, wherein the one or more bearing elements comprise a first bearing element and a second bearing element, and the housing further comprises:

an inner chamber defined within the housing to receive the rolling element;

a support opening defined in a bottom surface of the housing;

a first arcuate slot defined on a first lateral side of the housing; and a second arcuate slot defined on a second lateral side of the housing, wherein the first and second bearing elements are extendable within the housing via the first and second arcuate slots, respectively.

15. The rolling element assembly of claim 14, further comprising:

a support base extendable within the housing via the support opening; and a locking element extendable within the housing via a lock aperture defined in the top surface, wherein the locking element separates and moves a first and second support members into the arcuate grooves to secure the housing within the cavity.

16. The rolling element assembly of claim 15, wherein the first and second support members and the locking element cooperatively support the rolling element during rotation.

17. The rolling element assembly of claim 15, wherein the first and second support members each comprise an arcuate body having an inner arcuate surface and an outer arcuate surface opposite the inner arcuate surface, and wherein the first and second support members interpose the rolling element and the support base when installed in the housing such that a portion of the inner arcuate surface of each support member engages an outer circumferential surface of the rolling element, and a portion of the outer arcuate surface of each support member engages an upper arcuate surface of the support base.

18. The rolling element assembly of claim 14, wherein a length of the support opening is greater than a diameter of the rolling element and a length of the opening is less than the diameter of the rolling element.

19. The rolling element assembly of claim 13, further comprising an extraction feature provided on one or both of a support members and accessible via a lock aperture defined in a top surface of the housing.

20. The rolling element assembly of claim 13, wherein the one or more arcuate grooves include first and second arcuate grooves defined in opposing first and second sidewalls, respectively, of the cavity, the drill bit further comprising:

a first device cavity defined in the bit body and extending into the first arcuate groove;

a second device cavity defined in the bit body and extending into the second arcuate groove;

a first biasing device arranged within the first device cavity and engageable with a first support member; and a second biasing device arranged within the second device cavity and engageable with a second support member.

* * * * *